US010787727B2

(12) United States Patent
Hayashi et al.

(10) Patent No.: US 10,787,727 B2
(45) Date of Patent: Sep. 29, 2020

(54) STEEL SHEET

(71) Applicant: NIPPON STEEL & SUMITOMO METAL CORPORATION, Tokyo (JP)

(72) Inventors: Kunio Hayashi, Tokyo (JP); Masafumi Azuma, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/312,214

(22) PCT Filed: Sep. 21, 2016

(86) PCT No.: PCT/JP2016/077844
§ 371 (c)(1),
(2) Date: Dec. 20, 2018

(87) PCT Pub. No.: WO2018/055695
PCT Pub. Date: Mar. 29, 2018

(65) Prior Publication Data

US 2019/0330721 A1 Oct. 31, 2019

(51) Int. Cl.

| | |
|---|---|
| ***C22C 38/02*** | (2006.01) |
| ***C22C 38/12*** | (2006.01) |
| ***C22C 38/14*** | (2006.01) |
| ***C22C 38/42*** | (2006.01) |
| ***C22C 38/44*** | (2006.01) |
| ***C22C 38/46*** | (2006.01) |
| ***C22C 38/54*** | (2006.01) |
| ***C22C 38/58*** | (2006.01) |
| ***C21D 9/46*** | (2006.01) |

(52) U.S. Cl.
CPC ..... *C22C 38/02* (2013.01); *C21D 9/46* (2013.01); *C22C 38/12* (2013.01); *C22C 38/14* (2013.01); *C22C 38/42* (2013.01); *C22C 38/44* (2013.01); *C22C 38/46* (2013.01); *C22C 38/54* (2013.01); *C22C 38/58* (2013.01); *C21D 2211/001* (2013.01); *C21D 2211/002* (2013.01); *C21D 2211/005* (2013.01); *C21D 2211/008* (2013.01); *C21D 2211/009* (2013.01)

(58) Field of Classification Search
USPC ..... 148/332
See application file for complete search history.

(56) References Cited

U.S. PATENT DOCUMENTS

| | | | |
|---|---|---|---|
| 2011/0146852 | A1 | 6/2011 | Matsuda et al. |
| 2011/0198002 | A1 | 8/2011 | Nakagaito et al. |
| 2012/0222781 | A1 | 9/2012 | Azuma et al. |
| 2014/0000765 | A1 | 1/2014 | Nozaki et al. |
| 2014/0014236 | A1 | 1/2014 | Nozaki et al. |
| 2014/0044989 | A1 | 2/2014 | Toda et al. |
| 2014/0242416 | A1 | 8/2014 | Matsuda et al. |
| 2014/0377584 | A1 | 12/2014 | Hasegawa et al. |
| 2015/0101712 | A1 | 4/2015 | Futamura et al. |
| 2016/0160310 | A1 | 6/2016 | Hasegawa et al. |
| 2016/0369383 | A1 | 12/2016 | Toda et al. |
| 2017/0107591 | A1 | 4/2017 | Takashima et al. |

FOREIGN PATENT DOCUMENTS

| | | | |
|---|---|---|---|
| CN | 102312157 | A | 1/2012 |
| CN | 102639739 | A | 8/2012 |
| CN | 103857820 | A | 6/2014 |
| EP | 2267176 | A1 | 12/2010 |
| EP | 2757171 | A1 | 7/2014 |
| EP | 3128023 | A1 | 2/2017 |
| JP | 1-230715 | A | 9/1989 |
| JP | 2-217425 | A | 8/1990 |
| JP | 5896086 | B1 | 8/1990 |
| JP | 11-293383 | A | 10/1999 |
| JP | 2009-209450 | A | 9/2009 |
| JP | 2010-90475 | A | 4/2010 |
| JP | 2012-31462 | A | 2/2012 |
| JP | 2013-60657 | A | 4/2013 |
| JP | 2013-227653 | A | 11/2013 |
| JP | 2014-34716 | A | 2/2014 |
| WO | WO 2012/133563 | A1 | 10/2012 |
| WO | WO 2012/144567 | A1 | 10/2012 |
| WO | WO 2013/051238 | A1 | 4/2013 |
| WO | WO 2015/151427 | A1 | 10/2015 |

OTHER PUBLICATIONS

International Preliminary Report on Patentability and English translation of the Written Opinion of the International Searching Authority (forms PCT/IB/338, PCT/IB/373, and PCT/ISA/237) for International Application No. PCT/JP2016/077844, dated Apr. 4, 2019.
International Search Report for PCT/JP2016/077844 dated Nov. 22, 2016.
Written Opinion of the International Searching Authority for PCT/JP2016/077844 (PCT/ISA/237) dated Nov. 22, 2016.
Extended European Search Report, dated Jan. 28, 2020, for European Application No. 16916765.7.
Chinese Office Action and Search Report, dated May 19, 2020, for corresponding Chinese Application No. 201680086997 4, with an English translation.

*Primary Examiner* — Brian D Walck
(74) *Attorney, Agent, or Firm* — Birch, Stewart, Kolasch & Birch, LLP

(57) ABSTRACT

A steel sheet includes a predetermined chemical composition, and includes a steel structure represented by, in a volume fraction, tempered martensite and bainite: 70% or more and less than 92% in total, retained austenite: 8% or more and less than 30%, ferrite: less than 10%, fresh martensite: less than 10%, and pearlite: less than 10%. A number density of iron-base carbides in tempered martensite and lower bainite is $1.0\times10^6$ (pieces/mm$^2$) or more, and an effective crystal grain diameter of tempered martensite and bainite is 5 μm or less.

5 Claims, No Drawings

STEEL SHEET

TECHNICAL FIELD

The present invention relates to a high-strength steel sheet suitable for an automobile, building materials, home electric appliances, and the like.

BACKGROUND ART

For a reduction in weight and an improvement in collision safety of an automobile, the application of a high-strength steel sheet having a tensile strength of 980 MPa or more to an automobile member is rapidly expanding. Further, as a high-strength steel sheet by which good ductility is obtained, a TRIP steel sheet using transformation induced plasticity (TRIP) has been known.

However, a conventional TRIP steel sheet does not make it possible that other than tensile strength and ductility, hole expandability, hydrogen embrittlement resistance and toughness are compatible with one another.

CITATION LIST

Patent Literature

Patent Literature 1: Japanese Laid-open Patent Publication No. 11-293383

Patent Literature 2: Japanese Laid-open Patent Publication No. 1-230715

Patent Literature 3: Japanese Laid-open Patent Publication No. 2-217425

Patent Literature 4: Japanese Laid-open Patent Publication No. 2010-90475

Patent Literature 5: International Publication Pamphlet No. WO 2013/051238

Patent Literature 6: Japanese Laid-open Patent Publication No. 2013-227653

Patent Literature 7: International Publication Pamphlet No. WO 2012/133563

Patent Literature 8: Japanese Laid-open Patent Publication No. 2014-34716

Patent Literature 9: International Publication Pamphlet No. WO 2012/144567

SUMMARY OF INVENTION

Technical Problem

An object of the present invention is to provide a steel sheet which makes it possible that tensile strength, ductility, hole expandability, hydrogen embrittlement resistance and toughness are compatible with one another.

Solution to Problem

The present inventors have conducted keen studies in order to solve the above-described problem. As a result, they have appreciated that in a TRIP steel sheet, a main phase is set as tempered martensite or bainite, or both of these having a predetermined effective crystal grain diameter, and iron-base carbides having a predetermined number density are contained in tempered martensite and lower bainite, and thereby making it possible that tensile strength, ductility, hole expandability, hydrogen embrittlement resistance and toughness are compatible with one another.

The inventors of the present application have further conducted keen studies based on such an appreciation, and consequently have conceived embodiments of the invention indicated below.

(1) A steel sheet includes:

a chemical composition represented by, in mass %,

C: 0.15% to 0.45%,

Si: 1.0% to 2.5%,

Mn: 1.2% to 3.5%,

Al: 0.001% to 2.0%,

P: 0.02% or less,

S: 0.02% or less,

N: 0.007% or less,

O: 0.01% or less,

Mo: 0.0% to 1.0%,

Cr: 0.0% to 2.0%,

Ni: 0.0% to 2.0%,

Cu: 0.0% to 2.0%,

Nb: 0.0% to 0.3%,

Ti: 0.0% to 0.3%,

V: 0.0% to 0.3%,

B: 0.00% to 0.01%,

Ca: 0.00% to 0.01%,

Mg: 0.00% to 0.01%,

REM: 0.00% to 0.01%, and the balance: Fe and impurities, and comprising a steel structure represented by, in a volume fraction, tempered martensite and bainite: 70% or more and less than 92% in total, retained austenite: 8% or more and less than 30%, ferrite: less than 10%, fresh martensite: less than 10%, and pearlite: less than 10%, in which a number density of iron-base carbides in the tempered martensite and lower bainite is, in term of pieces/mm$^2$, $1.0\times10^6$ or more, and an effective crystal grain diameter of the tempered martensite and the bainite is 5 μm or less.

(2) The steel sheet according to (1), wherein the chemical composition further comprises, in mass %, one type or more selected from the group consisting of Mo: 0.01% to 1.0%, Cr: 0.05% to 2.0%, Ni: 0.05% to 2.0%, and Cu: 0.05% to 2.0%.

(3) The steel sheet according to (1), wherein the chemical composition further comprises, in mass %, one type or more selected from the group consisting of Nb: 0.005% to 0.3%, Ti: 0.005% to 0.3%, and V: 0.005% to 0.3%.

(4) The steel sheet according to, wherein the chemical composition further comprises, in mass %, B: 0.0001% to 0.01%.

(5) The steel sheet according to (1), wherein the chemical composition further comprises, in mass %, one type or more selected from the group consisting of Ca: 0.0005% to 0.01%, Mg: 0.0005% to 0.01%, and REM: 0.0005% to 0.01%.

Advantageous Effects of Invention

According to the present invention, a steel structure, an effective crystal grain diameter of tempered martensite and bainite, and the like are appropriate, and therefore, it is possible that tensile strength, ductility, hole expandability, hydrogen embrittlement resistance and toughness are compatible with one another.

DESCRIPTION OF EMBODIMENTS

Hereinafter, an embodiment of the present invention will be explained.

First, a steel structure of a steel sheet according to the embodiment of the present invention will be explained. The steel sheet according to this embodiment has a steel structure represented by, in a volume fraction, tempered martensite and bainite: 70% or more and less than 92% in total, retained austenite: 8% or more and less than 30%, ferrite: less than 10%, fresh martensite: less than 10%, and pearlite: less than 10%.

(Tempered Martensite and Bainite: 70% or More and Less than 92% in Total)

Tempered martensite and bainite are low-temperature transformation structures containing iron-base carbides and contribute to compatibility of hole expandability and hydrogen embrittlement resistance. When the volume fraction of tempered martensite and bainite is less than 70% in total, it becomes difficult that hole expandability and hydrogen embrittlement resistance are sufficiently compatible with each other. Accordingly, the volume fraction of tempered martensite and bainite is set to 70% or more in total. On the other hand, when the volume fraction of tempered martensite and bainite is 92% or more, the later-described retained austenite falls short. Accordingly, the volume fraction of tempered martensite and bainite is set to less than 92%.

Tempered martensite is an aggregation of lath-shaped crystal grains and contains iron-base carbides each having a major axis of 5 nm or more inside thereof. The iron-base carbides contained in tempered martensite each have a plurality of variants, and the iron-base carbides existing in one crystal grain each extend in a plurality of directions.

Bainite contains upper bainite and lower bainite. Lower bainite is an aggregation of lath-shaped crystal grains and contains iron-base carbides each having a major axis of 5 nm or more inside thereof. However, differently from tempered martensite, the iron-base carbides contained in lower bainite each have a single variant, and the iron-base carbides existing in one crystal grain each extend substantially in a single direction. "Substantially single direction" mentioned here means a direction having an angular difference within 5°. Upper bainite is an aggregation of lath-shaped crystal grains not containing an iron-base carbide inside thereof.

Tempered martensite and lower bainite can be distinguished depending on whether the direction in which the iron-base carbide extends is plural or single. As long as the volume fraction of tempered martensite and bainite is 70% or more in total, the distribution thereof is not limited. Details are described later, but this is because the variants of the iron-base carbide do not affect the compatibility of hole expandability and hydrogen embrittlement resistance. However, holding for a relatively long time at 300° C. to 500° C. is required for formation of bainite, and therefore, from the viewpoint of productivity, a ratio of tempered martensite is desirably higher.

(Retained Austenite: 8% or More and Less than 30%)

Retained austenite contributes to an improvement in ductility through transformation induced plasticity (TRIP). When the volume fraction of retained austenite is less than 8%, sufficient ductility is not obtained. Accordingly, the volume fraction of retained austenite is set to 8% or more, and desirably set to 10% or more. On the other hand, when the volume fraction of retained austenite is 30% or more, tempered martensite and bainite fall short. Accordingly, the volume fraction of retained austenite is set to less than 30%.

(Ferrite: Less than 10%)

Ferrite is a soft structure not containing a substructure such as lath inside thereof, and a crack accompanying an intensity difference is likely to occur on an interface with respect to tempered martensite and bainite being a hard structure. That is, ferrite makes toughness and hole expandability likely to deteriorate. Further, ferrite causes a deterioration in low-temperature toughness. Accordingly, the volume fraction of ferrite is preferably as low as possible. In particular, when the volume fraction of ferrite is 10% or more, decreases in toughness and hole expandability are remarkable. Accordingly, the volume fraction of ferrite is set to less than 10%.

(Fresh Martensite: Less than 10%)

Fresh martensite is martensite containing no iron-base carbide and remaining quenched, and contributes to an improvement in strength, but makes hydrogen embrittlement resistance greatly deteriorate. Further, fresh martensite causes a deterioration in low-temperature toughness accompanying a hardness difference with respect to tempered martensite and bainite. Accordingly, the volume fraction of fresh martensite is preferably as low as possible. In particular, when the volume fraction of fresh martensite is 10% or more, a deterioration in hydrogen embrittlement resistance is remarkable. Accordingly, the volume fraction of fresh martensite is set to less than 10%.

(Pearlite: Less than 10%)

Similarly to ferrite, pearlite makes toughness and hole expandability deteriorate. Accordingly, the volume fraction of pearlite is preferably as low as possible. In particular, when the volume fraction of pearlite is 10% or more, the decreases in toughness and hole expandability are remarkable. Accordingly, the volume fraction of pearlite is set to less than 10%.

Next, iron-base carbides in tempered martensite and lower bainite will be explained. A matching interface is included between iron-base carbides and a parent phase in tempered martensite and lower bainite, and a matching strain exists in the matching interface. This matching strain exhibits hydrogen trap ability, improves hydrogen embrittlement resistance, and improves delayed fracture resistance. When a number density of such iron-base carbides is less than $1.0\times10^6$ (pieces/mm$^2$), sufficient hydrogen embrittlement resistance is not obtained. Accordingly, the number density of iron-base carbides in tempered martensite and lower bainite is set to $1.0\times10^6$ (pieces/mm$^2$) or more, desirably set to $2.0\times10^6$ (pieces/mm$^2$) or more, and more desirably set to $3.0\times10^6$ (pieces/mm$^2$) or more.

An iron-base carbide is a generic name for carbides mainly composed of Fe and C, and for example, an ε carbide, a χ carbide, and cementite (θ carbide) having crystal structures different from one another belong to the iron-base carbide. Iron-base carbides exist with a specific orientation relationship in martensite and lower bainite being the parent phase. Other elements of Mn, Si, and Cr may be substituted for a part of Fe contained in the iron-base carbide. Even in this case, as long as the number density of iron-base carbides each having a major axis with a length of 5 nm or more is $1.0\times10^6$ (pieces/mm$^2$) or more, excellent hydrogen embrittlement resistance is obtained.

A counting target of the number density is set as an iron-base carbide having a major axis with a size of 5 nm or more. Although a scanning electron microscope and a transmission electron microscope have a limit to a size which they can observe, the iron-base carbide having a major axis with a size of about 5 nm or more can be observed. Iron-base carbides each having a major axis with a size of less than 5 nm may be contained in tempered martensite and lower bainite. The finer the iron-base carbide is, the more excellent hydrogen embrittlement resistance is obtained. Therefore, the iron-base carbide is desirably fine, and for example, an average length of the major axes is desirably 350 nm or less, more desirably 250 nm or less, and further desirably 200 nm or less.

So far it has not been appreciated that an iron-base carbide contributes to an improvement in hydrogen embrittlement resistance. This is considered because in general, for practical use of retained austenite and an improvement in formability accompanying this, importance has been particularly put on suppression of precipitation of iron-base carbides and the precipitation of iron-base carbides has been suppressed. In other words, it is considered that so far a steel sheet containing retained austenite and fine iron-base carbides has not been studied and such an effect as the improvement in hydrogen embrittlement resistance caused by iron-base carbides in TRIP steel has not been found.

Next, an effective crystal grain diameter of tempered martensite and bainite will be explained. A measuring method of the effective crystal grain diameter of tempered martensite and bainite will be described later, but when the effective crystal grain diameter of tempered martensite and bainite is more than 5 μm, sufficient toughness is not obtained. Accordingly, the effective crystal grain diameter of tempered martensite and bainite is set to 5 μm or less, and desirably set to 3 μm or less.

Next, an example of a method of measuring the volume fraction of each of the above-described structures will be explained.

In measurement of the volume fraction of each of ferrite, pearlite, upper bainite, lower bainite and tempered martensite, a sample is taken from a steel sheet with a cross section parallel to a rolling direction and parallel to a thickness direction being an observation surface. Next, the observation surface is polished and nital etched, and a range from a depth of t/8 to a depth of 3t/8 from the steel sheet surface in setting a thickness of the steel sheet as t is observed at 5000-fold magnification by a field emission scanning electron microscope (FE-SEM). This method allows ferrite, pearlite, bainite and tempered martensite to be identified. Tempered martensite, upper bainite and lower bainite can be distinguished from one another by presence/absence and extension directions of iron-base carbides in lath-shaped crystal grains. By making such an observation regarding ten visual fields, an area fraction of each of ferrite, pearlite, upper bainite, lower bainite and tempered martensite is obtained from an average value in the ten visual fields. Because the area fraction is equivalent to the volume fraction, it can be set as it is as the volume fraction. In this observation, the number density of iron-base carbides in tempered martensite and lower bainite can also be specified.

In measurement of the volume fraction of retained austenite, a sample is taken from the steel sheet, a portion from the steel sheet surface to a depth of t/4 is subjected to chemical polishing, and X-ray diffraction intensity with respect to a surface in a depth of t/4 from the steel sheet surface parallel to a rolled surface is measured. For example, a volume fraction V γ of retained austenite is represented by the following formula.

$$V\gamma=(I_{200f}+I_{220f}+I_{311f})/(I_{200b}+I_{211b})\times 100$$

($I_{200f}$, $I_{220f}$ and $I_{311f}$ indicate intensities of diffraction peaks of (200), (220), and (311) of a face-centered cubic lattice (fcc) phase respectively, and $I_{200b}$ and $I_{211b}$ indicate intensities of diffraction peaks of (200) and (211) of a body-centered cubic lattice (bcc) phase respectively.)

Fresh martensite and retained austenite are not sufficiently corroded by nital etching, and therefore, they can be distinguished from ferrite, pearlite, bainite and tempered martensite. Accordingly, the volume fraction of fresh martensite can be specified by subtracting the volume fraction V γ of retained austenite from the volume fraction of the balance in the FE-SEM observation.

In measurement of the effective crystal grain diameter of tempered martensite and bainite, a crystal orientation analysis is performed by electron back-scatter diffraction (EBSD). This analysis makes it possible to calculate a misorientation between two adjacent measurement points. Various points of view on the effective crystal grain diameter of tempered martensite and bainite exist, but the present inventors have found that a block boundary is an effective crystal unit with respect to crack propagation controlling toughness. The block boundary can be judged by an area surrounded by a boundary with a misorientation of about 10° or more, and therefore, on a crystal orientation map measured by the EBSD, it can be reflected by illustrating a boundary having a misorientation of 10° or more. A circle-equivalent diameter of an area surrounded by such a boundary having the misorientation of 10° or more is set as the effective crystal grain diameter. According to verification performed by the present inventors, when existence of the effective crystal grain diameter between measurement points with the misorientation of 10° or more is recognized, a significant correlation is confirmed between the effective crystal grain diameter and toughness.

Next, a chemical composition of a slab to be used for the steel sheet according to the embodiment of the present invention and manufacture thereof will be explained. As described above, the steel sheet according to the embodiment of the present invention is manufactured through hot rolling, cold rolling, continuous annealing, tempering treatment, and so on of the slab. Accordingly, the chemical composition of the steel sheet and the slab is in consideration of not only a property of the steel sheet but also these processes. In the following explanation, "%" which is a unit of a content of each of elements contained in the steel sheet and the slab means "mass %" unless otherwise stated. The steel sheet according to this embodiment has a chemical composition represented by, in mass %, C: 0.15% to 0.45%, Si: 1.0% to 2.5%, Mn: 1.2% to 3.5%, Al: 0.001% to 2.0%, P: 0.02% or less, S: 0.02% or less, N: 0.007% or less, O: 0.01% or less, Mo: 0.0% to 1.0%, Cr: 0.0% to 2.0%, Ni: 0.0% to 2.0%, Cu: 0.0% to 2.0%, Nb: 0.0% to 0.3%, Ti: 0.0% to 0.3%, V: 0.0% to 0.3%, B: 0.00% to 0.01%, Ca: 0.00% to 0.01%, Mg: 0.00% to 0.01%, REM: 0.00% to 0.01%, and the balance: Fe and impurities. As the impurities, the ones contained in raw materials such as ore and scrap and the ones contained in a manufacturing process are exemplified.

(C: 0.15% to 0.45%)

C contributes to an improvement in strength and contributes to an improvement in hydrogen embrittlement resistance through generation of iron-base carbides. When the C content is less than 0.15%, sufficient tensile strength, for example, a tensile strength of 980 MPa or more is not obtained. Accordingly, the C content is set to 0.15% or more, and desirably set to 0.18% or more. On the other hand, when the C content is more than 0.45%, a martensite transformation start temperature becomes extremely low, martensite with a sufficient volume fraction cannot be secured, and the volume fraction of tempered martensite and bainite cannot be set to 70% or more. Further, strength of welded portions sometimes falls short. Accordingly, the C content is set to 0.45% or less, and desirably set to 0.35% or less.

(Si: 1.0% to 2.5%)

Si contributes to the improvement in strength, and suppresses precipitation of coarse iron-base carbides in austenite to contribute to generation of stable retained austenite at room temperature. When the Si content is less than 1.0%, the precipitation of the coarse iron-base carbides cannot be sufficiently suppressed. Accordingly, the Si content is set to 1.0% or more, and desirably set to 1.2% or more. On the other hand, when the Si content is more than 2.5%, formability is decreased by embrittlement of the steel sheet. Accordingly, the Si content is set to 2.5% or less, and desirably set to 2.0% or less.

(Mn: 1.2% to 3.5%)

Mn contributes to the improvement in strength and suppresses a ferrite transformation during cooling after annealing. When the Mn content is less than 1.2%, ferrite is excessively generated, which makes it difficult to secure sufficient tensile strength, for example, a tensile strength of 980 MPa or more. Accordingly, the Mn content is set to 1.2% or more, and desirably set to 2.2% or more. On the other hand, when the Mn content is more than 3.5%, strength is excessively increased in the slab and the hot-rolled steel sheet, resulting in a decrease in manufacturability. Accordingly, the Mn content is set to 3.5% or less, and desirably set to 2.8% or less. From the viewpoint of manufacturability, Mn is desirably set to 3.00% or less.

(Al: 0.001% to 2.0%)

Al is inevitably contained in steel, but suppresses precipitation of coarse iron-base carbides in austenite to contribute to generation of stable retained austenite at room temperature. Al functions also as a deoxidizer. Accordingly, Al may be contained. On the other hand, when the Al content is more than 2.0%, manufacturability decreases. Accordingly, Al is set to 2.0% or less, and desirably set to 1.5% or less. A reduction of the Al content requires costs, and in an attempt to reduce it to less than 0.001%, the costs remarkably increase. Therefore, the Al content is set to 0.001% or more.

(P: 0.02% or Less)

P is not an essential element but, for example, is contained as an impurity in steel. P is likely to segregate in the middle portion in a thickness direction of the steel sheet, and causes welded portions to be embrittled. Therefore, the P content as low as possible is preferable. In particular, when the P content is more than 0.02%, a decrease in weldability is remarkable. Accordingly, the P content is set to 0.02% or less, and desirably set to 0.015% or less. A reduction of the P content requires costs, and in an attempt to reduce it to less than 0.0001%, the costs remarkably increase. Therefore, the P content may be set to 0.0001% or more.

(S: 0.02% or less)

S is not an essential element but, for example, is contained as an impurity in steel. S forms coarse MnS to decrease hole expandability. S sometimes decreases weldability and decreases manufacturability of casting and hot rolling. Therefore, the S content as low as possible is preferable. In particular, when the S content is more than 0.02%, a decrease in hole expandability is remarkable. Accordingly, the S content is set to 0.02% or less, and desirably set to 0.005% or less. A reduction of the S content requires costs, and in an attempt to reduce it to less than 0.0001%, the costs remarkably increase, Therefore, the S content may be set to 0.0001% or more.

(N: 0.007% or Less)

N is not an essential element but, for example, is contained as an impurity in steel. N forms a coarse nitride, which makes bendability and hole expandability deteriorate. N also causes occurrence of blowholes at a time of welding. Therefore, the N content as low as possible is preferable. In particular, when the N content is more than 0.007%, decreases in bendability and hole expandability are remarkable. Accordingly, the N content is set to 0.007% or less, and desirably set to 0.004% or less. A reduction of the N content requires costs, and in an attempt to reduce it to less than 0.0005%, the costs remarkably increase. Therefore, the N content may be set to 0.0005% or more.

(O: 0.01% or Less)

O is not an essential element but, for example, is contained as an impurity in steel. 0 forms an oxide to make formability deteriorate. Therefore, the 0 content as low as possible is preferable. In particular, when the 0 content is more than 0.01%, a decrease in formability becomes remarkable. Accordingly, the 0 content is set to 0.01% or less, and desirably set to 0.005% or less. A reduction of the 0 content requires costs, and in an attempt to reduce it to less than 0.0001%, the costs remarkably increase. Therefore, the 0 content may be set to 0.0001% or more.

Mo, Cr, Ni, Cu, Nb, Ti, V, B, Ca, Mg, and REM are not essential elements but optional elements which may be appropriately contained in the steel sheet and the slab within limits of predetermined amounts.

(Mo: 0.0% to 1.0%, Cr: 0.0% to 2.0%, Ni: 0.0% to 2.0%, Cu: 0.0% to 2.0%)

Mo, Cr, Ni and Cu contribute to the improvement in strength and suppress the ferrite transformation during cooling after annealing. Accordingly, Mo, Cr, Ni or Cu, or an arbitrary combination of these may be contained. In order to obtain this effect sufficiently, the Mo content is preferably 0.01% or more, the Cr content is preferably 0.05% or more, the Ni content is preferably 0.05% or more, and the Cu content is preferably 0.05% or more. On the other hand, when the Mo content is more than 1.0%, the Cr content is more than 2.0%, the Ni content is more than 2.0%, or the Cu content is more than 2.0%, manufacturability of hot rolling decreases. Accordingly, the Mo content is set to 1.0% or less, the Cr content is set to 2.0% or less, the Ni content is set to 2.0% or less, and the Cu content is set to 2.0% or less. That is, Mo: 0.01% to 1.0%, Cr: 0.05% to 2.0%, Ni: 0.05% to 2.0%, or Cu: 0.05% to 2.0%, or an arbitrary combination of these is preferably established.

(Nb: 0.0% to 0.3%, Ti: 0.0% to 0.3%, V: 0.0% to 0.3%)

Nb, Ti and V generate alloy carbonitride and contribute to the improvement in strength through precipitation strengthening and grain refining strengthening. Accordingly, Nb, Ti or V, or an arbitrary combination of these may be contained. In order to obtain this effect sufficiently, the Nb content is preferably 0.005% or more, the Ti content is preferably 0.005% or more, and the V content is preferably 0.005% or more. On the other hand, when the Nb content is more than 0.3%, the Ti content is more than 0.3%, or the V content is more than 0.3%, the alloy carbonitride precipitates excessively, and formability deteriorates. Accordingly, the Nb content is set to 0.3% or less, the Ti content is set to 0.3% or less, and the V content is set to 0.3% or less. That is, Nb: 0.005% to 0.3%, Ti: 0.005% to 0.3%, or V: 0.005% to 0.3%, or an arbitrary combination of these is preferably established.

(B: 0.00% to 0.01%)

B strengthens grain boundaries and suppresses the ferrite transformation during cooling after annealing. Accordingly, B may be contained. In order to obtain this effect sufficiently, the B content is preferably 0.0001% or more. On the other hand, when the B content is more than 0.01%, manufacturability of hot rolling decreases. Accordingly, the B content is set to 0.01% or less. That is, B: 0.0001% to 0.01% is preferably established.

(Ca: 0.00% to 0.01%, Mg: 0.00% to 0.01%, REM: 0.00% to 0.01%)

Ca, Mg and REM control a form of an oxide or a sulfide to contribute to an improvement in hole expandability. Accordingly, Ca, Mg or REM, or an arbitrary combination of these may be contained. In order to obtain this effect sufficiently, the Ca content is preferably 0.0005% or more, the Mg content is preferably 0.0005% or more, and the REM content is preferably 0.0005% or more. On the other hand, when the Ca content is more than 0.01%, the Mg content is more than 0.01%, or the REM content is more than 0.01%, manufacturability such as castability deteriorates. Accordingly, the Ca content is set to 0.01% or less, the Mg content is set to 0.01% or less, and the REM content is set to 0.01% or less. That is, Ca: 0.0005% to 0.01%, Mg: 0.0005% to 0.01%, or REM: 0.0005% to 0.01%, or an arbitrary combination of these is preferably established.

REM (rare earth metal) indicates total 17 types of elements of Sc, Y and lanthanoids, and "REM content" means a total content of these 17 types of elements. The REM is added by, for example, misch metal, and the misch metal sometimes contains the lanthanoids other than La and Ce. For the addition of the REM, a metal simple substance such as metal La or metal Ce may be used.

According to this embodiment, while obtaining high tensile strength, for example, a tensile strength of 980 MPa or more, preferably 1180 MPa or more, excellent ductility, hole expandability, hydrogen embrittlement resistance and toughness are obtained.

Next, a method of manufacturing the steel sheet according to the embodiment of the present invention will be explained. In the method of manufacturing the steel sheet according to the embodiment of the present invention, hot rolling, cold rolling, continuous annealing, tempering treatment, and so on of the steel having the above-described chemical composition are performed in this order.

(Hot Rolling)

In the hot rolling, rough rolling and finish rolling are performed. A method of manufacturing the slab to be provided for the hot rolling is not limited, but a continuously cast slab may be used or the one manufactured by a thin slab caster or the like may be used. Further, the hot rolling may be performed immediately after continuous casting. A cast slab is heated to 1150° C. or higher, after casting, without cooling or after cooling once. When a heating temperature is lower than 1150° C., a finish rolling temperature is likely to become lower than 850° C., and a rolling load becomes high. From the viewpoint of costs, the heating temperature is desirably set to lower than 1350° C.

In the rough rolling, rolling at a reduction ratio of 40% or more is performed at least one or more times at not lower than 1000° C. nor higher than 1150° C., and austenite is grain-refined before the finish rolling.

In the finish rolling, continuous rolling using five to seven finishing mills disposed at intervals of about 5 m is performed. Then, the rolling in the final three stages is performed at 1020° C. or lower, and a total reduction ratio of the rolling in the final three stages is set to 40% or more and a pass-through time during the rolling in the final three stages is set to 2.0 seconds or shorter. Further, water cooling is started in an elapsed time of 1.5 seconds or shorter from the rolling in the final stage. Here, the rolling in the final three stages means the rolling using the last three rolling mills. For example, when the continuous rolling is performed by six rolling mills, the rolling in the final three stages means the rolling with the fourth to sixth rolling mills, and when a sheet thickness in entering the fourth rolling mill is set as t4 and a sheet thickness in coming out of the sixth rolling mill is set as t6, the total reduction ratio of the rolling in the final three stages is calculated by "(t4−t6)/t4×100(%)". The pass-through time during the rolling in the final three stages means a time from the steel sheet coming out of the fourth rolling mill to coming out of the sixth rolling mill, and the elapsed time from the rolling in the final stage means a time from the steel sheet coming out of the sixth rolling mill to the water cooling being started. Between the rolling mill in the final stage and water-cooling equipment, a section in which properties of the steel sheet such as a temperature and a thickness are measured may exist.

To grain refining of a structure after the finish rolling, a reduction ratio, a temperature and an interpass time during the finish rolling are of importance.

When the temperature of the steel sheet becomes higher than 1020° C. during the rolling in the final three stages, austenite grains cannot be sufficiently grain-refined. Accordingly, the rolling in the final three stages is performed at 1020° C. or lower. When the continuous rolling is performed by six rolling mills, the rolling in the final three stages is performed at 1020° C. or lower, and therefore, an entry-side temperature in the fourth rolling mill is set to 1020° C. or lower, and also due to processing heat generation during the rolling thereafter, the temperature of the steel sheet is tried not to become higher than 1020° C.

When the total reduction ratio of the rolling in the final three stages is less than 40%, a cumulative rolling strain becomes insufficient, so that austenite grains cannot be sufficiently grain-refined. Accordingly, the total reduction ratio of the rolling in the final three stages is set to 40% or more.

The pass-through time during the rolling in the final three stages depends on the interpass time, and the longer this pass-through time is, the longer the interpass time is, so that recrystallization and grain growth of austenite grains are likely to progress between two continuous rolling mills. Then, when this pass-through time is longer than 2.0 seconds, the recrystallization and the grain growth of austenite grains are likely to become remarkable. Accordingly, the pass-through time during the rolling in the final three stages is set to 2.0 seconds or shorter. From the viewpoint of suppressing the recrystallization and the grain growth of austenite grains, the elapsed time from the rolling in the final stage to the water-cooling start is preferably as short as possible. When this elapsed time is longer than 1.5 seconds, the recrystallization and the grain growth of austenite grains are likely to become remarkable. Accordingly, the elapsed time from the rolling in the final stage to the water-cooling start is set to 1.5 seconds or shorter. Even when between the rolling mill in the final stage and the water-cooling equipment, the section in which the properties of the steel sheet such as a temperature and a thickness are measured exists, and the water cooling cannot be immediately started, the elapsed time being 1.5 seconds or shorter allows the suppression of the recrystallization and the grain growth of austenite grains.

Even though in a range where the ability of the finish rolling is not inhibited, cooling with a water-cooling nozzle or the like immediately after the finish rolling causes miniaturization of austenite grains, there is no problem. After the rough rolling, a plurality of rough rolling sheets obtained by the rough rolling may be bonded to one another, to continuously supply these for the finish rolling. Further, a rough rolling sheet may be coiled once, to supply this for the finish rolling while being uncoiled.

The finish rolling temperature (a completing temperature of the finish rolling) is set to not lower than 850° C. nor higher than 950° C. When the finish rolling temperature has two phase regions of austenite and ferrite, the structure of the steel sheet becomes nonuniform, so that excellent formability is not obtained. Further, when the finish rolling temperature is lower than 850° C., the rolling load becomes high. From the viewpoint of the grain refining of austenite grains, the finish rolling temperature is desirably set to 930° C. or lower.

A coiling temperature after the hot rolling is set to 730° C. or lower. When the coiling temperature is higher than 730° C., the effective crystal grain diameter of tempered martensite and bainite in the steel sheet is prevented from having 5 μm or less. Further, when the coiling temperature is higher than 730° C., a thick oxide is formed on the steel sheet surface, and picklability sometimes decreases. From the viewpoint of improving toughness by making the effective crystal grain diameter fine and improving hole expandability by uniformly dispersing retained austenite, the coiling temperature is desirably set to 680° C. or lower. A lower limit of the coiling temperature is not limited, but because coiling at room temperature or lower is technically difficult, the coiling temperature is made desirably higher than room temperature.

After the hot rolling, one-time or two or more-time pickling of the hot-rolled steel sheet obtained by the hot rolling is performed. By the pickling, oxides on the surface generated during the hot rolling are removed. The pickling also contributes to an improvement in conversion treatability of a cold-rolled steel sheet and an improvement in platability of a plated steel sheet.

Between from the hot rolling to the cold rolling, the hot-rolled steel sheet may be heated to 300° C. to 730° C. By this heat treatment (tempering treatment), the hot-rolled steel sheet is softened, which makes it easy to perform the cold rolling. When a heating temperature is higher than 730° C., a microstructure at a time of heating is turned into two phases of ferrite and austenite, and therefore, regardless of performing the tempering treatment aiming at softening, there is a possibility that strength of the hot-rolled steel sheet after cooling increases. Accordingly, a temperature of this heat treatment (tempering treatment) is set to 730° C. or lower, and preferably set to 650° C. or lower. On the other hand, when the heating temperature is lower than 300° C., a tempering effect is insufficient and the hot-rolled steel sheet is not sufficiently softened. Accordingly, the temperature of this heat treatment (tempering treatment) is set to 300° C. or higher, and preferably set to 400° C. or higher. Note that when long-time heat treatment is performed at 600° C. or higher, various alloy carbides precipitate during the heat treatment, and remelting of these alloy carbides becomes difficult during the continuous annealing thereafter, so that there is a possibility that a desired mechanical property is not obtained.

(Cold Rolling)

After the pickling, the cold rolling of the hot-rolled steel sheet is performed. A reduction ratio in the cold rolling is set to 30% to 90%. When the reduction ratio is less than 30%, austenite grains become coarse during the annealing, resulting in preventing the effective crystal grain diameter of tempered martensite and bainite in the steel sheet from having 5 μm or less. Accordingly, the reduction ratio is set to 30% or more, and desirably set to 40% or more. On the other hand, when the reduction ratio is more than 90%, a too high rolling load makes operation difficult. Accordingly, the reduction ratio is set to 90% or less, and desirably set to 70% or less. The number of times of rolling pass and a reduction ratio for each pass are not limited.

(Continuous Annealing)

After the cold rolling, the continuous annealing of the cold-rolled steel sheet obtained by the cold rolling is performed. The continuous annealing is performed in, for example, a continuous annealing line or a continuous hot-dip galvanizing line. A maximum heating temperature in the continuous annealing is set to 760° C. to 900° C. When the maximum heating temperature is lower than 760° C., the volume fraction of tempered martensite and bainite is less than 70% in total, which prevents hole expandability and hydrogen embrittlement resistance from being compatible with each other. On the other hand, when the maximum heating temperature is higher than 900° C., austenite grains become coarse, which prevents the effective crystal grain diameter of tempered martensite and bainite in the steel sheet from having 5 μm or less, or makes costs wastefully rise.

In the continuous annealing, holding is performed in a temperature zone of 760° C. to 900° C. for 20 seconds or longer. When a holding time is shorter than 20 seconds, the iron-base carbides cannot be melted sufficiently during the continuous annealing, and the volume fraction of tempered martensite and bainite becomes less than 70% in total, resulting in that not only hole expandability and hydrogen embrittlement resistance cannot be compatible with each other but also remaining coarse carbides make hole expandability and toughness deteriorate. From the viewpoint of costs, the holding time is desirably set to 1000 seconds or shorter. Isothermal holding may be performed at the maximum heating temperature, or immediately after performing inclined heating and reaching the maximum heating temperature, cooling may be started.

In the continuous annealing, an average heating rate from room temperature to the maximum heating temperature is set to 2° C./sec or more. When the average heating rate is less than 2° C./sec, a strain introduced by the cold rolling is relieved during a temperature rise, and austenite grains become coarse, which prevents the effective crystal grain diameter of tempered martensite and bainite in the steel sheet from having 5 μm or less.

After holding in the temperature zone of 760° C. to 900° C. for 20 seconds or longer, cooling is performed to 150° C. to 300° C., when an average cooling rate from a holding temperature to 300° C. is set to 5° C./sec or more. When a cooling stop temperature at this time is higher than 300° C., sufficient martensite is sometimes not generated even though the cooling stop temperature is higher than the martensite transformation start temperature or the cooling stop temperature is equal to or lower than the martensite transformation start temperature. As a result, the volume fraction of tempered martensite and bainite becomes less than 70% in total, which prevents hole expandability and hydrogen embrittlement resistance from being compatible with each other. When the cooling stop temperature is lower than 150° C., martensite is excessively generated, and the volume fraction of retained austenite becomes less than 8%. When the average cooling rate from the holding temperature to 300° C. is less than 5° C./sec, the ferrite is excessively generated during cooling, and sufficient martensite is not generated. From the viewpoint of costs, the average cooling rate is desirably set to 300° C./sec or less. Without limiting a cooling method, for example, hydrogen gas cooling, roll cooling, air cooling, or water cooling, or an arbitrary combination of these can be performed. During this cooling, nucleation sites for precipitating fine iron-base carbides in later tempering are introduced into martensite. In this cooling, the cooling stop temperature is important, and a holding time after a stop is not limited. This is because the volume fraction of tempered martensite and bainite depends on the cooling stop temperature but does not depend on the holding time.

(Tempering Treatment)

After the cooling to 150° C. to 300° C., reheating is performed to 300° C. to 500° C., and holding is performed in this temperature zone for 10 seconds or longer. The hydrogen embrittlement resistance of martensite generated by the cooling in the continuous annealing and remaining quenched is low. By the reheating to 300° C. to 500° C., the martensite is tempered, resulting in that the number density of iron-base carbides becomes $1.0\times10^6$ (pieces/mm$^2$) or more. Further, on the occasion of this reheating, bainite is generated or C diffuses from martensite and bainite to austenite, and therefore, austenite becomes stable.

When a temperature of the reheating (holding temperature) is higher than 500° C., martensite is excessively tempered, and sufficient tensile strength, for example, a tensile strength of 980 MPa or more is not obtained. Further, precipitated iron-base carbides become coarse, and sufficient hydrogen embrittlement resistance is sometimes not obtained. Furthermore, even though Si is contained, carbides are generated in austenite, to decompose the austenite, and therefore, the volume fraction of retained austenite becomes less than 8%, and sufficient formability is not obtained. The volume fraction of fresh martensite sometimes becomes 10% or more accompanying a decrease in the volume fraction of retained austenite. On the other hand, when the temperature of the reheating is lower than 300° C., due to insufficient tempering, the number density of iron-base carbides does not become $1.0\times10^6$ (pieces/mm$^2$) or more, and sufficient hydrogen embrittlement resistance is not obtained. When the holding time is shorter than 10 seconds, due to insufficient tempering, the number density of iron-base carbides does not become $1.0\times10^6$ (pieces/mm$^2$) or more, and sufficient hydrogen embrittlement resistance is not obtained. In addition, due to insufficient concentration of C into austenite, the volume fraction of retained austenite becomes less than 8%, and sufficient formability is sometimes not obtained. From the viewpoint of costs, the holding time is desirably set to 1000 seconds or shorter. Isothermal holding may be performed in a temperature zone of 300° C. to 500° C., or cooling or heating may be performed in this temperature zone.

Thus, the steel sheet according to the embodiment of the present invention can be manufactured.

After the tempering treatment, plating treatment by using Ni, Cu, Co, or Fe or an arbitrary combination of these may be performed. Performing such plating treatment allows improvements in conversion treatability and paintability. Further, the steel sheet is heated in an atmosphere having a dew point of −50° C. to 20° C., and a further improvement in chemical convertibility may be made by controlling a form of oxides to be formed on the surface of the steel sheet. The dew point in a furnace is made to rise once, Si, Mn, and the like which adversely affect the conversion treatability are oxidized inside the steel sheet, and by performing reduction treatment thereafter, the conversion treatability may be improved. Further, the steel sheet may be subjected to electroplating treatment. The tensile strength, ductility, hole expandability, hydrogen embrittlement resistance and toughness of the steel sheet are unaffected by the electroplating treatment. The steel sheet according to this embodiment is also suitable as a material for electroplating.

Further, the steel sheet may be subjected to hot-dip galvanizing treatment. When the hot-dip galvanizing treatment is performed, the above-described continuous annealing and tempering treatment are performed in the continuous hot-dip galvanizing line, and subsequently thereto, a temperature of the steel sheet is set to 400° C. to 500° C. and the steel sheet is immersed in a plating bath. When the temperature of the steel sheet is lower than 400° C., a heat removal of the plating bath at a time of entering for the immersion is large, which solidifies a part of molten zinc, so that an appearance of plating is sometimes impaired. On the other hand, when the temperature of the steel sheet is higher than 500° C., there is a possibility of causing an operation trouble accompanying a temperature rise of the plating bath. As long as the temperature of the steel sheet after the tempering treatment is lower than 400° C., it is sufficient that heating is performed to 400° C. to 500° C. before the immersion. The plating bath may be a pure zinc plating bath, or may contain Fe, Al, Mg, Mn, Si, or Cr or an arbitrary combination of these other than zinc.

Thus, a hot-dip galvanized steel sheet having a plating layer mainly composed of Zn can be obtained. The Fe content of the plating layer of the hot-dip galvanized steel sheet is less than about 7%.

The hot-dip galvanized steel sheet may be subjected to alloying treatment. A temperature of the alloying treatment is set to 450° C. to 550° C. When the temperature of the alloying treatment is lower than 450° C., progress of alloying is slow, and productivity is low. When the temperature of the alloying treatment is higher than 550° C., excellent formability is not obtained by the decomposition of austenite, or sufficient tensile strength is not obtained by excessive softening of tempered martensite.

Thus, an alloyed hot-dip galvanized steel sheet can be obtained. The Fe content of a plating layer of the alloyed hot-dip galvanized steel sheet is about 7% or more. Because a melting point of the plating layer of the alloyed hot-dip galvanized steel sheet is higher than a melting point of the plating layer of the hot-dip galvanized steel sheet, the alloyed hot-dip galvanized steel sheet is excellent in spot weldability.

On the occasion of the plating treatment, any of a Sendzimir method, a total reducing furnace method, and a flux method may be employed. In the Sendzimir method, after degreasing and pickling, heating is performed in a non-oxidizing atmosphere, and after annealing in a reducing atmosphere containing $H_2$ and $N_2$, cooling is performed to the vicinity of a plating bath temperature, to perform immersion in a plating bath. In the total reducing furnace method, an atmosphere at a time of annealing is adjusted, and after oxidizing the steel sheet surface at first, by reducing it thereafter, cleaning before the plating is performed, to thereafter perform immersion in the plating bath. In the flux method, after degreasing and pickling the steel sheet, flux treatment is performed by using ammonium chloride or the like, to perform immersion in the plating bath.

After the tempering treatment, after the plating treatment, or after the alloying treatment, skin pass rolling may be performed. A reduction ratio of the skin pass rolling is set to 1.0% or less. When the reduction ratio is more than 1.0%, the volume fraction of retained austenite decreases remarkably during the skin pass rolling. When the reduction ratio is less than 0.1%, an effect of the skin pass rolling is small and control thereof is also difficult. The skin pass rolling may be performed in an in-line manner in the continuous annealing line, or may be performed in an off-line manner after completing the continuous annealing in the continuous annealing line. The skin pass rolling may be performed at a time, or may be performed by being divided into a plurality of times so that a total reduction ratio becomes 1.0% or less.

Note that the above-described embodiment merely illustrates concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, examples of the present invention will be explained. Conditions in examples are condition examples employed for confirming the applicability and effects of the present invention and the present invention is not limited to these examples. The present invention can employ various conditions as long as the object of the present invention is achieved without departing from the spirit of the present invention.

Slabs having chemical compositions presented in Table 1 were heated to 1230° C., and hot rolling was performed under conditions presented in Table 2 and Table 3 to obtain hot-rolled steel sheets each having a thickness of 2.5 mm. In the hot rolling, water cooling was performed after rough rolling, and finish rolling using six rolling mills, to thereafter coil the hot-rolled steel sheets. "CR" of a steel type in Table 2 and Table 3 indicates a cold-rolled steel sheet, "GI" thereof indicates a hot-dip galvanized steel sheet, and "GA" thereof indicates an alloyed hot-dip galvanized steel sheet. "Extraction temperature" in Table 2 and Table 3 is a temperature of each of the slabs when they are extracted from a heating furnace in slab heating before the rough rolling. "The number of passes" is the number of passes of rolling at a reduction ratio of 40% or more at not lower than 1000° C. nor higher than 1150° C. "A first interpass time" is a time from the steel sheet coming out of a fourth rolling mill to entering a fifth rolling mill, and "a second interpass time" is a time from the steel sheet coming out of the fifth rolling mill to entering a sixth rolling mill. "Elapsed time" is a time from the steel sheet coming out of the sixth rolling mill to the water cooling being started, and "pass-through time" is a time from the steel sheet coming out of the fourth rolling mill to coming out of the sixth rolling mill. "Total reduction ratio", when a sheet thickness in entering the fourth rolling mill is set as t4 and a sheet thickness in coming out of the sixth rolling mill is set as t6, is calculated by "(t4−t6)/t4×100(%)". The balance of each of the chemical compositions presented in Table 1 is Fe and impurities. Underlines in Table 1 indicate that numerical values thereon deviate from a range of the present invention. Underlines in Table 2 and Table 3 indicate that numerical values thereon deviate from a range suitable for manufacturing the steel sheet according to the present invention.

TABLE 1

| MARK OF | CHEMICAL COMPOSITION (MASS %) | | | | | | | | |
|---|---|---|---|---|---|---|---|---|---|
| STEEL | C | Si | Mn | P | S | Al | N | O | OTHERS |
| A | 0.185 | 1.68 | 2.33 | 0.0090 | 0.0021 | 0.016 | 0.0021 | 0.0025 | |
| B | 0.192 | 1.47 | 1.85 | 0.0100 | 0.0020 | 0.021 | 0.0025 | 0.0020 | |
| C | 0.169 | 1.45 | 2.40 | 0.0120 | 0.0030 | 0.020 | 0.0035 | 0.0021 | Nb: 0.009 |
| D | 0.201 | 1.66 | 2.35 | 0.0110 | 0.0025 | 0.030 | 0.0031 | 0.0025 | Ti: 0.052 |
| E | 0.177 | 1.43 | 1.35 | 0.0090 | 0.0023 | 0.025 | 0.0030 | 0.0031 | Cr: 0.62 |
| F | 0.191 | 2.12 | 2.10 | 0.0085 | 0.0031 | 0.250 | 0.0033 | 0.0021 | Ti: 0.024, B: 0.0017 |
| G | 0.184 | 1.91 | 2.66 | 0.0090 | 0.0025 | 0.031 | 0.0029 | 0.0022 | |
| H | 0.204 | 1.85 | 2.85 | 0.0110 | 0.0033 | 0.021 | 0.0024 | 0.0024 | |
| I | 0.199 | 1.34 | 1.74 | 0.0120 | 0.0035 | 0.024 | 0.0035 | 0.0024 | Cr: 0.95 |
| J | 0.195 | 1.44 | 2.43 | 0.0098 | 0.0031 | 0.035 | 0.0021 | 0.0031 | Ti: 0.023, B: 0.0008 |
| K | 0.221 | 1.86 | 2.30 | 0.0066 | 0.0024 | 0.031 | 0.0031 | 0.0031 | Mo: 0.20 |
| L | 0.206 | 1.34 | 2.31 | 0.0115 | 0.0034 | 0.021 | 0.0025 | 0.0021 | Ni: 0.41, Cu: 0.25 |
| M | 0.211 | 1.49 | 2.66 | 0.0109 | 0.0025 | 0.022 | 0.0025 | 0.0028 | Nb: 0.031 |
| N | 0.234 | 1.69 | 2.31 | 0.0091 | 0.0031 | 0.221 | 0.0031 | 0.0030 | B: 0.0010 |
| O | 0.213 | 1.34 | 2.62 | 0.0119 | 0.0035 | 0.040 | 0.0031 | 0.0029 | Ca: 0.0021 |
| P | 0.294 | 1.41 | 2.82 | 0.0130 | 0.0043 | 0.036 | 0.0034 | 0.0025 | Mg: 0.0034 |
| Q | 0.331 | 1.56 | 2.84 | 0.0160 | 0.0042 | 0.002 | 0.0037 | 0.0038 | REM: 0.0013 |
| R | 0.321 | 1.95 | 2.91 | 0.0110 | 0.0034 | 0.030 | 0.0036 | 0.0024 | V: 0.046 |
| S | 0.361 | 1.43 | 2.67 | 0.0090 | 0.0026 | 0.024 | 0.0025 | 0.0020 | |
| T | 0.372 | 1.50 | 2.56 | 0.0080 | 0.0025 | 0.026 | 0.0036 | 0.0023 | Nb: 0.024 |
| U | 0.394 | 1.49 | 2.27 | 0.0070 | 0.0022 | 0.028 | 0.0030 | 0.0012 | B: 0.0029 |
| V | 0.441 | 1.41 | 1.94 | 0.0080 | 0.0021 | 0.086 | 0.0021 | 0.0032 | Cr: 0.67 |
| W | 0.432 | 1.64 | 3.11 | 0.0094 | 0.0021 | 0.030 | 0.0024 | 0.0021 | |
| X | 0.428 | 1.75 | 2.66 | 0.0091 | 0.0031 | 0.021 | 0.0024 | 0.0030 | Ti: 0.016, B: 0.0016 |
| Y | 0.435 | 1.70 | 2.35 | 0.0092 | 0.0033 | 0.031 | 0.0025 | 0.0031 | Cr: 0.31 |
| a | 0.122 | 1.35 | 1.82 | 0.0121 | 0.0020 | 0.032 | 0.0044 | 0.0032 | |
| b | 0.495 | 1.44 | 1.92 | 0.0115 | 0.0033 | 0.024 | 0.0031 | 0.0031 | |
| c | 0.205 | 0.41 | 2.55 | 0.0095 | 0.0031 | 0.004 | 0.0030 | 0.0029 | |
| d | 0.184 | 1.33 | 0.91 | 0.0088 | 0.0025 | 0.031 | 0.0031 | 0.0020 | |
| e | 0.199 | 1.55 | 2.69 | 0.0310 | 0.0041 | 0.031 | 0.0050 | 0.0020 | |
| f | 0.322 | 1.66 | 1.90 | 0.0088 | 0.0411 | 0.035 | 0.0031 | 0.0025 | |
| g | 0.211 | 1.58 | 2.81 | 0.0104 | 0.0034 | 2.511 | 0.0034 | 0.0033 | |

TABLE 1-continued

| MARK OF STEEL | CHEMICAL COMPOSITION (MASS %) | | | | | | | | |
|---|---|---|---|---|---|---|---|---|---|
| | C | Si | Mn | P | S | Al | N | O | OTHERS |
| h | 0.330 | 1.45 | 2.82 | 0.0120 | 0.0031 | 0.040 | 0.0043 | | |
| i | 0.299 | 1.98 | 1.99 | 0.0130 | 0.0019 | 0.042 | 0.0034 | | |
| j | 0.160 | 1.32 | 2.36 | 0.0090 | 0.0009 | 0.003 | 0.0021 | 0.0024 | Nb: 0.008 |
| k | 0.180 | 1.23 | 2.24 | 0.0130 | 0.0013 | 0.072 | 0.0021 | 0.0023 | Nb: 0.006 |

TABLE 2

| | | | | ROUGH ROLLING | FINISH ROLLING | | | | | | | | | |
|---|---|---|---|---|---|---|---|---|---|---|---|---|---|---|
| | | | | | CONDITIONS IN FOURTH ROLLING MILL | | | | | | | | CONDITIONS IN FIFTH ROLLING MILL | |
| | | | | | ENTRY SIDE | | | EXIT SIDE | | | | | EXIT SIDE | |
| SAMPLE | MARK OF STEEL | STEEL TYPE | EXTRACTION TEMPERATURE (° C.) | THE NUMBER OF PASSES (TIMES) | THICK-NESS (mm) | TEMPER-ATURE (° C.) | SHEET PASSAGE SPEED (m/min) | THICK-NESS (mm) | TEMPER-ATURE (° C.) | SHEET PASSAGE SPEED (m/min) | REDUCTION RATIO (%) | FIRST INTERPASS TIME (sec) | THICK-NESS (mm) | TEMPER-ATURE (° C.) |
| A-1 | A | CR | 1235 | 3 | 4.8 | 1005 | 208 | 3.6 | 980 | 278 | 25 | 1.1 | 2.8 | 950 |
| A-2 | A | CR | 1220 | 2 | 4.9 | 1010 | 424 | 3.7 | 1005 | 562 | 24 | 0.5 | 3.0 | 960 |
| A-3 | A | CR | 1200 | 2 | 5.2 | 980 | 265 | 3.9 | 940 | 354 | 25 | 0.8 | 2.8 | 910 |
| A-4 | A | CR | 1210 | 2 | 5.1 | 1005 | 471 | 3.9 | 970 | 615 | 24 | 0.5 | 2.8 | 940 |
| A-5 | A | CR | 1244 | 2 | 5.3 | 995 | 634 | 3.8 | 950 | 884 | 28 | 0.3 | 2.9 | 930 |
| A-6 | A | GI | 1235 | 3 | 5.2 | 1010 | 218 | 3.8 | 980 | 299 | 27 | 1.0 | 2.9 | 950 |
| A-7 | A | GI | 1231 | 2 | 5.1 | 1010 | 323 | 3.7 | 990 | 445 | 27 | 0.7 | 2.8 | 960 |
| A-8 | A | GA | 1130 | 2 | 5.2 | 1010 | 236 | 3.5 | 985 | 350 | 33 | 0.9 | 2.8 | 950 |
| A-9 | A | GA | 1239 | 2 | 5.1 | 1005 | 309 | 3.8 | 990 | 415 | 25 | 0.7 | 2.8 | 935 |
| A-10 | A | GA | 1220 | 2 | 5.0 | 995 | 209 | 3.8 | 955 | 276 | 24 | 1.1 | 2.7 | 920 |
| A-11 | A | GA | 1231 | 2 | 5.2 | 1005 | 385 | 3.9 | 975 | 513 | 25 | 0.6 | 2.8 | 950 |
| B-1 | B | CR | 1240 | 1 | 5.3 | 1010 | 471 | 3.4 | 980 | 734 | 36 | 0.4 | 2.8 | 950 |
| C-1 | C | CR | 1230 | 1 | 5.1 | 1005 | 452 | 3.8 | 960 | 606 | 25 | 0.5 | 2.9 | 935 |
| D-1 | D | CR | 1221 | 1 | 5.2 | 1005 | 425 | 3.8 | 955 | 581 | 27 | 0.5 | 2.8 | 925 |
| E-1 | E | CR | 1219 | 1 | 5.0 | 995 | 300 | 3.8 | 945 | 395 | 24 | 0.8 | 2.7 | 925 |
| F-1 | F | CR | 1244 | 2 | 4.8 | 990 | 833 | 3.4 | 955 | 1176 | 29 | 0.3 | 2.7 | 905 |
| G-1 | G | CR | 1234 | 2 | 4.9 | 1010 | 490 | 3.8 | 975 | 632 | 22 | 0.5 | 2.7 | 955 |
| G-2 | G | CR | 1229 | 3 | 5.2 | 1015 | 738 | 3.8 | 985 | 1011 | 27 | 0.3 | 2.8 | 945 |
| G-3 | G | CR | 1231 | 2 | 5.1 | 1015 | 541 | 3.7 | 990 | 746 | 27 | 0.4 | 2.8 | 970 |
| G-4 | G | CR | 1241 | 2 | 5.2 | 995 | 1108 | 3.8 | 955 | 1516 | 27 | 0.2 | 2.8 | 930 |
| G-5 | G | CR | 1244 | 1 | 5.1 | 1010 | 784 | 3.9 | 960 | 1026 | 24 | 0.3 | 2.9 | 925 |
| G-6 | G | CR | 1198 | 3 | 5.1 | 995 | 433 | 3.9 | 975 | 566 | 24 | 0.5 | 2.9 | 935 |
| G-7 | G | GI | 1211 | 2 | 5.0 | 1000 | 461 | 3.4 | 980 | 678 | 32 | 0.4 | 2.8 | 955 |
| G-8 | G | GI | 1205 | 2 | 5.2 | 1015 | 480 | 3.8 | 1005 | 657 | 27 | 0.5 | 2.8 | 980 |
| G-9 | G | GI | 1209 | 2 | 5.0 | 1010 | 480 | 3.8 | 975 | 632 | 24 | 0.5 | 2.9 | 940 |
| H-1 | H | CR | 1217 | 2 | 5.2 | 1015 | 462 | 3.8 | 970 | 632 | 27 | 0.5 | 2.9 | 930 |
| I-1 | I | CR | 1219 | 2 | 5.1 | 1010 | 471 | 3.8 | 990 | 632 | 25 | 0.5 | 2.8 | 965 |
| J-1 | J | CR | 1221 | 2 | 5.2 | 985 | 354 | 3.7 | 955 | 497 | 29 | 0.6 | 2.8 | 935 |
| K-1 | K | CR | 1219 | 2 | 5.1 | 990 | 376 | 3.8 | 935 | 505 | 25 | 0.6 | 2.9 | 885 |
| L-1 | L | CR | 1221 | 2 | 5.2 | 1010 | 554 | 3.8 | 975 | 758 | 27 | 0.4 | 2.8 | 935 |
| M-1 | M | CR | 1241 | 1 | 5.1 | 935 | 392 | 3.9 | 945 | 513 | 24 | 0.6 | 2.8 | 910 |
| N-1 | N | CR | 1231 | 2 | 5.0 | 1010 | 480 | 3.8 | 985 | 632 | 24 | 0.5 | 2.9 | 935 |
| O-1 | O | CR | 1238 | 1 | 5.2 | 1010 | 577 | 3.8 | 985 | 789 | 27 | 0.4 | 2.8 | 965 |
| P-1 | P | CR | 1224 | 2 | 5.0 | 1015 | 267 | 3.8 | 1000 | 351 | 24 | 0.9 | 2.8 | 980 |
| Q-1 | Q | CR | 1216 | 2 | 5.0 | 995 | 499 | 3.8 | 945 | 657 | 24 | 0.5 | 2.8 | 915 |
| R-1 | R | CR | 1223 | 2 | 5.1 | 1015 | 306 | 3.9 | 985 | 400 | 24 | 0.8 | 2.9 | 945 |

TABLE 2-continued

| | FINISH ROLLING | | | | | | | | | | | | |
|---|---|---|---|---|---|---|---|---|---|---|---|---|---|
| | CONDITIONS IN FIFTH ROLLING MILL EXIT SIDE | | | | CONDITIONS IN SIXTH ROLLING MILL EXIT SIDE | | | | | | | | |
| SAMPLE | SHEET PASSAGE SPEED (m/min) | PRESENCE/ ABSENCE OF INTER-STAND COOLING | REDUCTION RATIO (%) | SECOND INTERPASS TIME (sec) | THICK-NESS (mm) | FINISHING TEMPER-ATURE (° C.) | SHEET PASSAGE SPEED (m/min) | REDUCTION RATIO (%) | ELAPSED TIME (sec) | PASS-THROUGH TIME (sec) | TOTAL REDUCTION RATIO (%) | COILING TEMPER-ATURE (° C.) | REMARK |
| A-1 | 357 | — | 22 | 0.8 | 2.5 | 930 | 400 | 11 | 1.2 | 1.9 | 48 | 640 | FOR INVENTION EXAMPLE |
| A-2 | 693 | — | 19 | 0.4 | 2.6 | 940 | 800 | 13 | 0.6 | 1.0 | 47 | 640 | FOR COMPARATIVE EXAMPLE |
| A-3 | 493 | — | 28 | 0.6 | 2.3 | 880 | 600 | 18 | 0.8 | 1.5 | 56 | 600 | FOR COMPARATIVE EXAMPLE |
| A-4 | 857 | — | 28 | 0.4 | 2.5 | 910 | 960 | 11 | 0.5 | 0.8 | 51 | 590 | FOR COMPARATIVE EXAMPLE |
| A-5 | 1159 | — | 24 | 0.3 | 2.4 | 900 | 1400 | 17 | 0.6 | 0.6 | 55 | 540 | FOR COMPARATIVE EXAMPLE |
| A-6 | 391 | — | 24 | 0.8 | 2.6 | 920 | 436 | 10 | 1.1 | 1.8 | 50 | 560 | FOR INVENTION EXAMPLE |
| A-7 | 588 | — | 24 | 0.5 | 2.4 | 940 | 686 | 14 | 0.7 | 1.2 | 53 | 480 | FOR COMPARATIVE EXAMPLE |
| A-8 | 438 | — | 20 | 0.7 | 2.3 | 930 | 533 | 18 | 0.9 | 1.5 | 56 | 600 | FOR INVENTION EXAMPLE |
| A-9 | 563 | — | 26 | 0.5 | 2.3 | 910 | 636 | 18 | 0.7 | 1.3 | 55 | 560 | FOR COMPARATIVE EXAMPLE |
| A-10 | 388 | — | 29 | 0.8 | 2.4 | 900 | 436 | 11 | 1.1 | 1.9 | 52 | 600 | FOR COMPARATIVE EXAMPLE |
| A-11 | 714 | — | 28 | 0.4 | 2.5 | 930 | 800 | 11 | 0.6 | 1.0 | 52 | 630 | FOR COMPARATIVE EXAMPLE |
| B-1 | 891 | PRESENCE | 18 | 0.3 | 2.6 | 870 | 960 | 7 | 0.5 | 0.7 | 51 | 560 | FOR INVENTION EXAMPLE |
| C-1 | 794 | — | 24 | 0.4 | 2.4 | 900 | 960 | 17 | 0.5 | 0.9 | 53 | 600 | FOR INVENTION EXAMPLE |
| D-1 | 789 | — | 26 | 0.4 | 2.3 | 890 | 960 | 18 | 0.5 | 0.9 | 56 | 620 | FOR INVENTION EXAMPLE |
| E-1 | 556 | — | 29 | 0.5 | 2.5 | 900 | 600 | 7 | 0.3 | 1.3 | 50 | 570 | FOR INVENTION EXAMPLE |
| F-1 | 1481 | — | 21 | 0.2 | 2.5 | 880 | 1600 | 7 | 0.3 | 0.5 | 48 | 580 | FOR INVENTION EXAMPLE |
| G-1 | 889 | — | 29 | 0.3 | 2.5 | 930 | 960 | 7 | 0.5 | 0.8 | 49 | 550 | FOR INVENTION EXAMPLE |
| G-2 | 1371 | — | 26 | 0.2 | 2.4 | 920 | 1600 | 14 | 0.3 | 0.5 | 54 | 630 | FOR COMPARATIVE EXAMPLE |
| G-3 | 986 | — | 24 | 0.3 | 2.3 | 940 | 1200 | 18 | 0.4 | 0.7 | 55 | 550 | FOR INVENTION EXAMPLE |
| G-4 | 2057 | — | 26 | 0.1 | 2.4 | 890 | 2400 | 14 | 0.2 | 0.3 | 54 | 500 | FOR INVENTION EXAMPLE |
| G-5 | 1379 | — | 26 | 0.2 | 2.5 | 900 | 1600 | 14 | 0.3 | 0.5 | 51 | 570 | FOR COMPARATIVE |

TABLE 2-continued

| | | | | | | | | | | | | | |
|---|---|---|---|---|---|---|---|---|---|---|---|---|---|
| | | | | | | | | | | | | | EXAMPLE |
| G-6 | 761 | — | 26 | 0.4 | 2.3 | 910 | 960 | 21 | 0.5 | 0.9 | 55 | 600 | FOR COMPARATIVE EXAMPLE |
| G-7 | 823 | — | 18 | 0.4 | 2.4 | 920 | 960 | 14 | 0.5 | 0.8 | 52 | 700 | FOR INVENTION EXAMPLE |
| G-8 | 891 | — | 26 | 0.3 | 2.6 | 940 | 960 | 7 | 0.5 | 0.8 | 50 | 520 | FOR COMPARATIVE EXAMPLE |
| G-9 | 828 | — | 24 | 0.4 | 2.5 | 910 | 960 | 14 | 0.5 | 0.8 | 50 | 570 | FOR COMPARATIVE EXAMPLE |
| H-1 | 828 | — | 24 | 0.4 | 2.5 | 900 | 960 | 14 | 0.5 | 0.8 | 52 | 620 | FOR INVENTION EXAMPLE |
| I-1 | 857 | — | 26 | 0.4 | 2.5 | 930 | 960 | 11 | 0.5 | 0.8 | 51 | 450 | FOR INVENTION EXAMPLE |
| J-1 | 657 | — | 24 | 0.5 | 2.3 | 910 | 800 | 18 | 0.6 | 1.1 | 56 | 630 | FOR INVENTION EXAMPLE |
| K-1 | 662 | — | 24 | 0.5 | 2.4 | 860 | 800 | 17 | 0.6 | 1.0 | 53 | 600 | FOR INVENTION EXAMPLE |
| L-1 | 1029 | — | 26 | 0.3 | 2.4 | 900 | 1200 | 14 | 0.4 | 0.7 | 54 | 550 | FOR INVENTION EXAMPLE |
| M-1 | 714 | — | 28 | 0.4 | 2.5 | 880 | 800 | 11 | 0.6 | 1.0 | 51 | 700 | FOR INVENTION EXAMPLE |
| N-1 | 828 | — | 24 | 0.4 | 2.5 | 890 | 960 | 14 | 0.5 | 0.8 | 50 | 650 | FOR INVENTION EXAMPLE |
| O-1 | 1071 | — | 26 | 0.3 | 2.5 | 950 | 1200 | 11 | 0.4 | 0.7 | 52 | 670 | FOR INVENTION EXAMPLE |
| P-1 | 476 | — | 26 | 0.6 | 2.5 | 945 | 533 | 11 | 0.9 | 1.5 | 50 | 610 | FOR INVENTION EXAMPLE |
| Q-1 | 891 | — | 26 | 0.3 | 2.6 | 880 | 960 | 7 | 0.5 | 0.8 | 48 | 550 | FOR INVENTION EXAMPLE |
| R-1 | 538 | — | 26 | 0.6 | 2.6 | 920 | 600 | 10 | 0.8 | 1.3 | 49 | 520 | FOR INVENTION EXAMPLE |

TABLE 3

| | | | | ROUGH ROLLING | FINISH ROLLING | | | | | | | | | |
|---|---|---|---|---|---|---|---|---|---|---|---|---|---|---|
| | | | | | CONDITIONS IN FOURTH ROLLING MILL | | | | | | | | CONDITIONS IN FIFTH ROLLING MILL | |
| | | | | | ENTRY SIDE | | | EXIT SIDE | | | | | EXIT SIDE | |
| SAMPLE | MARK OF STEEL | STEEL TYPE | EXTRACTION TEMPERATURE (° C.) | THE NUMBER OF PASSES (TIMES) | THICK-NESS (mm) | TEMPER-ATURE (° C.) | SHEET PASSAGE SPEED (m/min) | THICK-NESS (mm) | TEMPER-ATURE (° C.) | SHEET PASSAGE SPEED (m/min) | REDUCTION RATIO (%) | FIRST INTERPASS TIME (sec) | THICK-NESS (mm) | TEMPER-ATURE (° C.) |
| S-1 | S | CR | 1234 | 2 | 5.2 | 1010 | 480 | 3.7 | 1005 | 675 | 29 | 0.4 | 2.9 | 985 |
| S-2 | S | CR | 1245 | 0 | 5.2 | 1045 | 277 | 3.8 | 1020 | 379 | 27 | 0.8 | 2.9 | 995 |
| S-3 | S | CR | 1220 | 2 | 5.1 | 1015 | 107 | 3.8 | 985 | 144 | 25 | 2.1 | 2.8 | 970 |
| S-4 | S | CR | 1225 | 2 | 3.8 | 1005 | 351 | 3.3 | 965 | 404 | 13 | 0.7 | 2.7 | 925 |
| S-5 | S | CR | 1221 | 2 | 5.2 | 1015 | 480 | 3.8 | 985 | 657 | 27 | 0.5 | 2.8 | 955 |
| S-6 | S | CR | 1191 | 3 | 5.1 | 985 | 392 | 3.8 | 945 | 526 | 25 | 0.6 | 2.8 | 910 |
| S-7 | S | GI | 1224 | 1 | 5.1 | 1010 | 282 | 3.8 | 975 | 379 | 25 | 0.8 | 2.8 | 935 |
| S-8 | S | GI | 1219 | 2 | 5.0 | 1015 | 277 | 3.8 | 985 | 365 | 24 | 0.8 | 2.9 | 925 |
| S-9 | S | GI | 1231 | 2 | 5.2 | 995 | 330 | 3.6 | 965 | 476 | 31 | 0.6 | 2.9 | 930 |
| S-10 | S | GI | 1222 | 2 | 5.0 | 995 | 288 | 3.7 | 955 | 389 | 26 | 0.8 | 2.9 | 915 |
| S-11 | S | GI | 1213 | 2 | 5.1 | 1015 | 294 | 3.8 | 995 | 395 | 25 | 0.8 | 2.9 | 965 |
| S-12 | S | GI | 1210 | 2 | 5.2 | 1010 | 218 | 3.8 | 985 | 299 | 27 | 1.0 | 2.9 | 955 |
| S-13 | S | GA | 1204 | 2 | 5.1 | 1010 | 408 | 3.8 | 985 | 547 | 25 | 0.5 | 2.8 | 970 |
| S-14 | S | GA | 1206 | 2 | 5.2 | 1015 | 554 | 3.7 | 995 | 778 | 29 | 0.4 | 2.8 | 975 |
| T-1 | T | CR | 1204 | 2 | 5.3 | 1010 | 283 | 3.8 | 965 | 395 | 28 | 0.8 | 2.7 | 930 |
| U-1 | U | CR | 1204 | 3 | 5.2 | 1010 | 283 | 3.9 | 990 | 385 | 25 | 0.8 | 2.8 | 975 |
| V-1 | V | CR | 1224 | 2 | 5.1 | 1015 | 306 | 3.7 | 995 | 422 | 27 | 0.7 | 2.8 | 965 |
| W-1 | W | CR | 1221 | 2 | 5.2 | 1010 | 267 | 3.8 | 990 | 365 | 27 | 0.8 | 2.8 | 960 |
| W-2 | W | GI | 1222 | 2 | 5.1 | 985 | 471 | 3.8 | 950 | 632 | 25 | 0.5 | 2.9 | 910 |
| W-3 | W | GA | 1234 | 2 | 5.1 | 995 | 323 | 3.9 | 945 | 422 | 24 | 0.7 | 2.9 | 915 |
| X-1 | X | CR | 1228 | 2 | 5.2 | 1010 | 300 | 3.7 | 960 | 422 | 29 | 0.7 | 2.7 | 935 |
| Y-1 | Y | CR | 1229 | 2 | 5.1 | 1015 | 392 | 3.8 | 985 | 526 | 25 | 0.6 | 2.8 | 955 |
| a-1 | a | CR | 1231 | 2 | 5.2 | 990 | 462 | 3.7 | 945 | 649 | 29 | 0.5 | 2.8 | 915 |
| b-1 | b | CR | 1224 | 2 | 5.1 | 1015 | 471 | 3.6 | 985 | 667 | 29 | 0.5 | 2.9 | 935 |
| c-1 | c | CR | 1226 | 2 | 5.2 | 1010 | 400 | 3.8 | 990 | 547 | 27 | 0.5 | 2.8 | 965 |
| d-1 | d | CR | 1241 | 1 | 5.2 | 1015 | 443 | 3.6 | 995 | 640 | 31 | 0.5 | 2.8 | 960 |
| e-1 | e | CR | 1244 | 1 | 5.1 | 1010 | 294 | 3.8 | 980 | 395 | 25 | 0.8 | 2.9 | 945 |
| f-1 | f | CR | 1231 | 2 | 5.2 | 1015 | 288 | 3.7 | 980 | 405 | 29 | 0.7 | 2.7 | 960 |
| g-1 | g | CR | 1194 | 3 | 5.1 | 1010 | 541 | 3.7 | 980 | 746 | 27 | 0.4 | 2.8 | 950 |
| h-1 | h | GI | 1205 | 3 | 5.5 | 960 | 116 | 3.8 | 930 | 168 | 31 | 1.8 | 2.7 | 880 |
| i-1 | i | CR | 1210 | 2 | 5.2 | 1040 | 288 | 3.8 | 975 | 395 | 27 | 0.8 | 2.8 | 960 |
| j-1 | j | CR | 1205 | 2 | 5.3 | 1045 | 252 | 3.9 | 960 | 342 | 26 | 0.9 | 2.8 | 940 |
| k-1 | k | CR | 1220 | 2 | 5.1 | 1015 | 129 | 3.8 | 955 | 173 | 25 | 1.7 | 2.8 | 935 |
| l-1 | A | — | 1110 | 3 | STEEL SHEET TEMPERATURE DECREASES, AND FINISH ROLLING IS JUDGED DIFFICULT. | | | | | | | | | |

TABLE 3-continued

| | FINISH ROLLING | | | | | | | | | | | | |
|---|---|---|---|---|---|---|---|---|---|---|---|---|---|
| | CONDITIONS IN FIFTH ROLLING MILL EXIT SIDE | | | | CONDITIONS IN SIXTH ROLLING MILL EXIT SIDE | | | | | | | | |
| SAMPLE | SHEET PASSAGE SPEED (m/min) | PRESENCE/ ABSENCE OF INTER-STAND COOLING | REDUCTION RATIO (%) | SECOND INTERPASS TIME (sec) | THICK-NESS (mm) | FINISHING TEMPER-ATURE (° C.) | SHEET PASSAGE SPEED (m/min) | REDUCTION RATIO (%) | ELAPSED TIME (sec) | PASS-THROUGH TIME (sec) | TOTAL REDUCTION RATIO (%) | COILING TEMPER-ATURE (° C.) | REMARK |
| S-1 | 861 | — | 22 | 0.3 | 2.6 | 950 | 960 | 10 | 0.5 | 0.8 | 50 | 480 | FOR INVENTION EXAMPLE |
| S-2 | 497 | — | 24 | 0.6 | 2.4 | 975 | 600 | 17 | 0.8 | 1.4 | 54 | 600 | FOR COMPARATIVE EXAMPLE |
| S-3 | 195 | — | 26 | 1.5 | 2.5 | 945 | 218 | 11 | 2.2 | 3.6 | 51 | 560 | FOR COMPARATIVE EXAMPLE |
| S-4 | 494 | — | 18 | 0.6 | 2.5 | 900 | 533 | 7 | 0.9 | 1.4 | 34 | 600 | FOR COMPARATIVE EXAMPLE |
| S-5 | 891 | — | 26 | 0.3 | 2.6 | 930 | 960 | 7 | 0.5 | 0.8 | 50 | 630 | FOR COMPARATIVE EXAMPLE |
| S-6 | 714 | — | 26 | 0.4 | 2.5 | 870 | 800 | 11 | 0.6 | 1.0 | 51 | 560 | FOR COMPARATIVE EXAMPLE |
| S-7 | 514 | — | 26 | 0.6 | 2.4 | 900 | 600 | 14 | 0.8 | 1.4 | 53 | 600 | FOR INVENTION EXAMPLE |
| S-8 | 478 | — | 24 | 0.6 | 2.6 | 890 | 533 | 10 | 0.9 | 1.4 | 48 | 620 | FOR COMPARATIVE EXAMPLE |
| S-9 | 591 | — | 19 | 0.5 | 2.5 | 900 | 686 | 14 | 0.7 | 1.1 | 52 | 570 | FOR COMPARATIVE EXAMPLE |
| S-10 | 497 | — | 22 | 0.6 | 2.4 | 880 | 600 | 17 | 0.8 | 1.4 | 52 | 580 | FOR COMPARATIVE EXAMPLE |
| S-11 | 517 | — | 24 | 0.6 | 2.5 | 930 | 600 | 14 | 0.8 | 1.3 | 51 | 650 | FOR COMPARATIVE EXAMPLE |
| S-12 | 391 | — | 24 | 0.8 | 2.6 | 920 | 436 | 10 | 1.1 | 1.8 | 50 | 630 | FOR COMPARATIVE EXAMPLE |
| S-13 | 743 | — | 26 | 0.4 | 2.6 | 940 | 800 | 7 | 0.6 | 1.0 | 49 | 550 | FOR COMPARATIVE EXAMPLE |
| S-14 | 1029 | PRESENCE | 24 | 0.3 | 2.4 | 890 | 1200 | 14 | 0.4 | 0.7 | 54 | 500 | FOR COMPARATIVE EXAMPLE |
| T-1 | 556 | — | 29 | 0.5 | 2.5 | 880 | 600 | 7 | 0.8 | 1.3 | 53 | 550 | FOR INVENTION EXAMPLE |
| U-1 | 536 | — | 28 | 0.6 | 2.5 | 945 | 600 | 11 | 0.8 | 1.3 | 52 | 600 | FOR INVENTION EXAMPLE |
| V-1 | 557 | — | 24 | 0.5 | 2.6 | 910 | 600 | 7 | 0.8 | 1.3 | 49 | 540 | FOR INVENTION EXAMPLE |
| W-1 | 495 | — | 26 | 0.6 | 2.6 | 930 | 533 | 7 | 0.9 | 1.4 | 50 | 590 | FOR INVENTION EXAMPLE |
| W-2 | 823 | — | 24 | 0.4 | 2.5 | 870 | 960 | 14 | 0.5 | 0.8 | 51 | 600 | FOR COMPARATIVE EXAMPLE |
| W-3 | 567 | — | 26 | 0.5 | 2.4 | 890 | 686 | 17 | 0.7 | 1.2 | 53 | 570 | FOR INVENTION EXAMPLE |
| X-1 | 578 | — | 27 | 0.5 | 2.6 | 900 | 600 | 4 | 0.8 | 1.2 | 50 | 520 | FOR INVENTION |

TABLE 3-continued

| | | | | | | | | | | | | | |
|---|---|---|---|---|---|---|---|---|---|---|---|---|---|
| | | | | | | | | | | | | | EXAMPLE |
| Y-1 | 714 | — | 26 | 0.4 | 2.5 | 920 | 800 | 11 | 0.6 | 1.0 | 51 | 490 | FOR INVENTION EXAMPLE |
| a-1 | 857 | — | 24 | 0.4 | 2.5 | 870 | 960 | 11 | 0.5 | 0.8 | 52 | 570 | FOR COMPARATIVE EXAMPLE |
| b-1 | 828 | — | 19 | 0.4 | 2.5 | 900 | 960 | 14 | 0.5 | 0.8 | 51 | 620 | FOR COMPARATIVE EXAMPLE |
| c-1 | 743 | — | 26 | 0.4 | 2.6 | 930 | 800 | 7 | 0.6 | 1.0 | 50 | 450 | FOR COMPARATIVE EXAMPLE |
| d-1 | 823 | — | 22 | 0.4 | 2.4 | 930 | 960 | 14 | 0.5 | 0.8 | 54 | 450 | FOR COMPARATIVE EXAMPLE |
| e-1 | 517 | — | 24 | 0.6 | 2.5 | 930 | 600 | 14 | 0.8 | 1.3 | 51 | 450 | FOR COMPARATIVE EXAMPLE |
| f-1 | 556 | — | 27 | 0.5 | 2.5 | 930 | 600 | 7 | 0.8 | 1.3 | 52 | 450 | FOR COMPARATIVE EXAMPLE |
| g-1 | 986 | — | 24 | 0.3 | 2.3 | 930 | 1200 | 18 | 0.4 | 0.7 | 55 | 450 | FOR COMPARATIVE EXAMPLE |
| h-1 | 237 | — | 29 | 1.3 | 2.4 | 850 | 267 | 11 | 1.8 | 3.0 | 56 | 660 | FOR COMPARATIVE EXAMPLE |
| i-1 | 536 | — | 26 | 0.6 | 2.5 | 940 | 600 | 11 | 0.8 | 1.3 | 52 | 530 | FOR COMPARATIVE EXAMPLE |
| j-1 | 476 | — | 28 | 0.6 | 2.5 | 920 | 533 | 11 | 0.9 | 1.5 | 53 | 540 | FOR COMPARATIVE EXAMPLE |
| k-1 | 235 | — | 26 | 1.3 | 2.6 | 910 | 253 | 7 | 1.9 | 3.0 | 49 | 540 | FOR COMPARATIVE EXAMPLE |
| l-1 | STEEL SHEET TEMPERATURE DECREASES, AND FINISH ROLLING IS JUDGED DIFFICULT. | | | | | | | | | | | | FOR COMPARATIVE EXAMPLE |

Next, the hot-rolled steel sheets were each pickled, and cold rolling was performed to obtain cold-rolled steel sheets each having a thickness of 1.2 mm. Thereafter, continuous annealing and tempering treatment of the cold-rolled steel sheets were performed under conditions presented in Table 4 and Table 5, and skin pass rolling having a reduction ratio of 0.1% was performed. In the continuous annealing, holding temperatures in Table 4 and Table 5 were each set as a maximum heating temperature. Cooling rates are each an average cooling rate from the holding temperature to 300° C. Regarding a part of samples, hot-dip galvanizing treatment was performed between the tempering treatment and the skin pass rolling. A weight at this time was set to about 50 g/m$^2$ with respect to each of both surfaces. Regarding a part of the samples subjected to the hot-dip galvanizing treatment, alloying treatment was performed under conditions presented in Table 4 and Table 5 between the hot-dip galvanizing treatment and the skin pass rolling. Continuous hot-dip galvanizing equipment was used for the hot-dip galvanizing treatment, and the continuous annealing, the tempering treatment and the hot-dip galvanizing treatment were continuously performed. Underlines in Table 4 and Table 5 indicate that numerical values thereon deviate from a range suitable for manufacturing the steel sheet according to the present invention.

TABLE 4

| | | | CONTINUOUS ANNEALING | | | | |
|---|---|---|---|---|---|---|---|
| SAMPLE | MARK OF STEEL | STEEL TYPE | HEATING RATE (° C./sec) | HOLDING TEMPERATURE (° C.) | HOLDING TIME (sec) | COOLING RATE (° C./sec) | COOLING STOP TEMPERATURE (° C.) |
| A-1 | A | CR | 2.5 | 850 | 210 | 13 | 260 |
| A-2 | A | CR | 3.1 | 850 | 156 | 15 | 460 |
| A-3 | A | CR | 4.2 | 860 | 234 | 24 | 25 |
| A-4 | A | CR | 4.1 | 870 | 191 | 23 | 250 |
| A-5 | A | CR | 3.5 | 850 | 234 | 28 | 260 |
| A-6 | A | GI | 3.8 | 870 | 122 | 34 | 280 |
| A-7 | A | GI | 3.4 | 860 | 95 | 55 | 250 |
| A-8 | A | GA | 3.4 | 850 | 67 | 52 | 280 |
| A-9 | A | GA | 2.4 | 860 | 43 | 35 | 270 |
| A-10 | A | GA | 5.1 | 755 | 66 | 38 | 270 |
| A-11 | A | GA | 5.4 | 880 | 75 | 45 | 465 |
| B-1 | B | CR | 5.6 | 810 | 110 | 32 | 250 |
| C-1 | C | CR | 4.5 | 805 | 134 | 33 | 220 |
| D-1 | D | CR | 4.8 | 800 | 121 | 22 | 240 |
| E-1 | E | CR | 2.4 | 805 | 134 | 23 | 250 |
| F-1 | F | CR | 6.5 | 810 | 127 | 25 | 230 |
| G-1 | G | CR | 4.4 | 840 | 124 | 64 | 250 |
| G-2 | G | CR | 0.4 | 790 | 135 | 35 | 220 |
| G-3 | G | CR | 2.5 | 850 | 241 | 13 | 260 |
| G-4 | G | CR | 2.6 | 850 | 221 | 35 | 250 |
| G-5 | G | CR | 2.8 | 860 | 5 | 26 | 220 |
| G-6 | G | CR | 2.9 | 870 | 252 | 33 | 105 |
| G-7 | G | GI | 2.4 | 850 | 262 | 35 | 190 |
| G-8 | G | GI | 2.8 | 850 | 242 | 4 | 510 |
| G-9 | G | GI | 2.9 | 860 | 162 | 35 | 25 |
| H-1 | H | CR | 4.5 | 830 | 95 | 46 | 230 |
| I-1 | I | CR | 3.8 | 830 | 68 | 55 | 240 |
| J-1 | J | CR | 3.4 | 840 | 61 | 58 | 250 |
| K-1 | K | CR | 3.6 | 830 | 112 | 52 | 220 |
| L-1 | L | CR | 3.8 | 820 | 120 | 31 | 230 |
| M-1 | M | CR | 3.5 | 840 | 95 | 15 | 250 |
| N-1 | N | CR | 4.5 | 820 | 90 | 21 | 210 |
| O-1 | O | CR | 6.5 | 860 | 77 | 25 | 230 |
| P-1 | P | CR | 5.8 | 845 | 95 | 26 | 240 |
| Q-1 | Q | CR | 6.8 | 855 | 68 | 28 | 260 |
| R-1 | R | CR | 6.3 | 860 | 120 | 23 | 270 |

| | TEMPERING | | ALLOYING | | |
|---|---|---|---|---|---|
| SAMPLE | HOLDING TEMPERATURE (° C.) | HOLDING TIME (sec) | HOT-DIP GALVANIZING TREATMENT | TREATMENT TEMPERATURE (° C.) | REMARK |
| A-1 | 400 | 350 | ABSENCE | ABSENCE | FOR INVENTION EXAMPLE |
| A-2 | 400 | 380 | ABSENCE | ABSENCE | FOR COMPARATIVE EXAMPLE |
| A-3 | 390 | 500 | ABSENCE | ABSENCE | FOR COMPARATIVE EXAMPLE |
| A-4 | 270 | 560 | ABSENCE | ABSENCE | FOR COMPARATIVE EXAMPLE |
| A-5 | 520 | 450 | ABSENCE | ABSENCE | FOR COMPARATIVE EXAMPLE |
| A-6 | 420 | 320 | PRESENCE | ABSENCE | FOR INVENTION EXAMPLE |

TABLE 4-continued

| | | | | | |
|---|---|---|---|---|---|
| A-7 | 420 | 5 | PRESENCE | ABSENCE | FOR COMPARATIVE EXAMPLE |
| A-8 | 390 | 35 | PRESENCE | 480 | FOR INVENTION EXAMPLE |
| A-9 | 400 | 120 | PRESENCE | 610 | FOR COMPARATIVE EXAMPLE |
| A-10 | 380 | 140 | PRESENCE | 510 | FOR COMPARATIVE EXAMPLE |
| A-11 | 480 | 100 | PRESENCE | 500 | FOR COMPARATIVE EXAMPLE |
| B-1 | 400 | 150 | ABSENCE | ABSENCE | FOR INVENTION EXAMPLE |
| C-1 | 380 | 120 | ABSENCE | ABSENCE | FOR INVENTION EXAMPLE |
| D-1 | 390 | 95 | ABSENCE | ABSENCE | FOR INVENTION EXAMPLE |
| E-1 | 400 | 46 | ABSENCE | ABSENCE | FOR INVENTION EXAMPLE |
| F-1 | 400 | 60 | ABSENCE | ABSENCE | FOR INVENTION EXAMPLE |
| G-1 | 400 | 350 | ABSENCE | ABSENCE | FOR INVENTION EXAMPLE |
| G-2 | 390 | 380 | ABSENCE | ABSENCE | FOR COMPARATIVE EXAMPLE |
| G-3 | 400 | 400 | ABSENCE | ABSENCE | FOR INVENTION EXAMPLE |
| G-4 | 400 | 420 | ABSENCE | ABSENCE | FOR INVENTION EXAMPLE |
| G-5 | 250 | 400 | ABSENCE | ABSENCE | FOR COMPARATIVE EXAMPLE |
| G-6 | 530 | 390 | ABSENCE | ABSENCE | FOR COMPARATIVE EXAMPLE |
| G-7 | 420 | 420 | PRESENCE | ABSENCE | FOR INVENTION EXAMPLE |
| G-8 | 380 | 360 | PRESENCE | ABSENCE | FOR COMPARATIVE EXAMPLE |
| G-9 | 370 | 3 | PRESENCE | ABSENCE | FOR COMPARATIVE EXAMPLE |
| H-1 | 400 | 380 | ABSENCE | ABSENCE | FOR INVENTION EXAMPLE |
| I-1 | 390 | 400 | ABSENCE | ABSENCE | FOR INVENTION EXAMPLE |
| J-1 | 420 | 410 | ABSENCE | ABSENCE | FOR INVENTION EXAMPLE |
| K-1 | 410 | 390 | ABSENCE | ABSENCE | FOR INVENTION EXAMPLE |
| L-1 | 380 | 400 | ABSENCE | ABSENCE | FOR INVENTION EXAMPLE |
| M-1 | 460 | 60 | ABSENCE | ABSENCE | FOR INVENTION EXAMPLE |
| N-1 | 450 | 70 | ABSENCE | ABSENCE | FOR INVENTION EXAMPLE |
| O-1 | 435 | 75 | ABSENCE | ABSENCE | FOR INVENTION EXAMPLE |
| P-1 | 450 | 80 | ABSENCE | ABSENCE | FOR INVENTION EXAMPLE |
| Q-1 | 400 | 60 | ABSENCE | ABSENCE | FOR INVENTION EXAMPLE |
| R-1 | 380 | 65 | ABSENCE | ABSENCE | FOR INVENTION EXAMPLE |

TABLE 5

| | | | CONTINUOUS ANNEALING | | | | |
|---|---|---|---|---|---|---|---|
| SAMPLE | MARK OF STEEL | STEEL TYPE | HEATING RATE (° C./sec) | HOLDING TEMPERATURE (° C.) | HOLDING TIME (sec) | COOLING RATE (° C./sec) | COOLING STOP TEMPERATURE (° C.) |
| S-1 | S | CR | 4.5 | 860 | 80 | 45 | 250 |
| S-2 | S | CR | 5.5 | 850 | 89 | 35 | 280 |
| S-3 | S | CR | 6.8 | 860 | 67 | 38 | 270 |
| S-4 | S | CR | 6.4 | 790 | 89 | 34 | 270 |
| S-5 | S | CR | 5.5 | 880 | 90 | 24 | 510 |
| S-6 | S | CR | 0.4 | 830 | 113 | 25 | 250 |
| S-7 | S | GI | 3.5 | 850 | 135 | 28 | 220 |

TABLE 5-continued

| | | | | | | | |
|---|---|---|---|---|---|---|---|
| S-8 | S | GI | 3.7 | 950 | 250 | 30 | 240 |
| S-9 | S | GI | 3.8 | 850 | 3 | 28 | 250 |
| S-10 | S | GI | 3.9 | 850 | 280 | 2 | 230 |
| S-11 | S | GI | 3.8 | 850 | 260 | 44 | 250 |
| S-12 | S | GI | 3.5 | 790 | 240 | 46 | 220 |
| S-13 | S | GA | 4.5 | 850 | 260 | 50 | 430 |
| S-14 | S | GA | 4.5 | 850 | 209 | 28 | 90 |
| T-1 | T | CR | 4.6 | 840 | 201 | 26 | 260 |
| U-1 | U | CR | 4.5 | 840 | 259 | 40 | 250 |
| V-1 | V | CR | 5.2 | 850 | 240 | 28 | 250 |
| W-1 | W | CR | 9.8 | 860 | 204 | 29 | 230 |
| W-2 | W | GI | 10.2 | 860 | 206 | 34 | 250 |
| W-3 | W | GA | 2.8 | 860 | 208 | 35 | 250 |
| X-1 | X | CR | 2.9 | 850 | 60 | 39 | 250 |
| Y-1 | Y | CR | 3.5 | 860 | 65 | 34 | 250 |
| a-1 | a | CR | 4.5 | 850 | 67 | 29 | 250 |
| b-1 | b | CR | 6.5 | 830 | 85 | 28 | 230 |
| c-1 | c | CR | 6.8 | 830 | 92 | 28 | 240 |
| d-1 | d | CR | 6.4 | 830 | 94 | 26 | 240 |
| e-1 | e | CR | 5.5 | 830 | 97 | 27 | 240 |
| f-1 | f | CR | 6.8 | 830 | 95 | 15 | 240 |
| g-1 | g | CR | 6.4 | 830 | 96 | 13 | 240 |
| h-1 | h | GI | 3.0 | 850 | 180 | 15 | 200 |
| i-1 | i | CR | 3.0 | 830 | 180 | 10 | 300 |
| j-1 | j | CR | 5.0 | 840 | 30 | 8 | 170 |
| k-1 | k | CR | 5.0 | 840 | 30 | 7 | 290 |

| | TEMPERING | | | ALLOYING | |
|---|---|---|---|---|---|
| SAMPLE | HOLDING TEMPERATURE (° C.) | HOLDING TIME (sec) | HOT-DIP GALVANIZING TREATMENT | TREATMENT TEMPERATURE (° C.) | REMARK |
| S-1 | 420 | 70 | ABSENCE | ABSENCE | FOR INVENTION EXAMPLE |
| S-2 | 390 | 60 | ABSENCE | ABSENCE | FOR COMPARATIVE EXAMPLE |
| S-3 | 400 | 120 | ABSENCE | ABSENCE | FOR COMPARATIVE EXAMPLE |
| S-4 | 380 | 140 | ABSENCE | ABSENCE | FOR COMPARATIVE EXAMPLE |
| S-5 | 480 | 100 | ABSENCE | ABSENCE | FOR COMPARATIVE EXAMPLE |
| S-6 | 400 | 400 | ABSENCE | ABSENCE | FOR COMPARATIVE EXAMPLE |
| S-7 | 380 | 400 | PRESENCE | ABSENCE | FOR INVENTION EXAMPLE |
| S-8 | 390 | 380 | PRESENCE | ABSENCE | FOR COMPARATIVE EXAMPLE |
| S-9 | 400 | 460 | PRESENCE | ABSENCE | FOR COMPARATIVE EXAMPLE |
| S-10 | 400 | 350 | PRESENCE | ABSENCE | FOR COMPARATIVE EXAMPLE |
| S-11 | 560 | 350 | PRESENCE | ABSENCE | FOR COMPARATIVE EXAMPLE |
| S-12 | 390 | 1200 | PRESENCE | ABSENCE | FOR COMPARATIVE EXAMPLE |
| S-13 | 400 | 400 | PRESENCE | 490 | FOR COMPARATIVE EXAMPLE |
| S-14 | 400 | 420 | PRESENCE | 600 | FOR COMPARATIVE EXAMPLE |
| T-1 | 390 | 420 | ABSENCE | ABSENCE | FOR INVENTION EXAMPLE |
| U-1 | 380 | 300 | ABSENCE | ABSENCE | FOR INVENTION EXAMPLE |
| V-1 | 410 | 360 | ABSENCE | ABSENCE | FOR INVENTION EXAMPLE |
| W-1 | 405 | 300 | ABSENCE | ABSENCE | FOR INVENTION EXAMPLE |
| W-2 | 510 | 400 | PRESENCE | ABSENCE | FOR COMPARATIVE EXAMPLE |
| W-3 | 390 | 120 | PRESENCE | ABSENCE | FOR INVENTION EXAMPLE |
| X-1 | 400 | 380 | ABSENCE | ABSENCE | FOR INVENTION EXAMPLE |
| Y-1 | 410 | 400 | ABSENCE | ABSENCE | FOR INVENTION EXAMPLE |
| a-1 | 400 | 390 | ABSENCE | ABSENCE | FOR COMPARATIVE EXAMPLE |

TABLE 5-continued

| | | | | | |
|---|---|---|---|---|---|
| b-1 | 400 | 380 | ABSENCE | ABSENCE | FOR COMPARATIVE EXAMPLE |
| c-1 | 390 | 400 | ABSENCE | ABSENCE | FOR COMPARATIVE EXAMPLE |
| d-1 | 390 | 400 | ABSENCE | ABSENCE | FOR COMPARATIVE EXAMPLE |
| e-1 | 390 | 400 | ABSENCE | ABSENCE | FOR COMPARATIVE EXAMPLE |
| f-1 | 390 | 400 | ABSENCE | ABSENCE | FOR COMPARATIVE EXAMPLE |
| g-1 | 390 | 400 | ABSENCE | ABSENCE | FOR COMPARATIVE EXAMPLE |
| h-1 | 450 | 90 | PRESENCE | ABSENCE | FOR COMPARATIVE EXAMPLE |
| i-1 | 410 | 60 | ABSENCE | ABSENCE | FOR COMPARATIVE EXAMPLE |
| j-1 | 430 | 300 | ABSENCE | ABSENCE | FOR COMPARATIVE EXAMPLE |
| k-1 | 430 | 300 | ABSENCE | ABSENCE | FOR COMPARATIVE EXAMPLE |

Then, steel structures of the steel sheets after the skin pass rolling were observed, and a volume fraction of each of the structures and a number density and an average size of iron-base carbides were measured. Table 6 and Table 7 present these results. Underlines in Table 6 and Table 7 indicate that numerical values thereon deviate from a range of the present invention. "Average length" in Table 6 and Table 7 means an average length of major axes of the iron-base carbides, and blank columns therein indicate that a too low number density of the iron-base carbides does not allow the measurement.

TABLE 6

| | STEEL STRUCTURE (%) | | | | | | |
|---|---|---|---|---|---|---|---|
| SAMPLE | FERRITE | UPPER BAINITE | LOWER BAINITE | FRESH MARTENSITE | TEMPERED MARTENSITE | RETAINED AUSTENITE | PEARLITE |
| A-1 | 5 | 5 | 11 | 3 | 65 | 11 | 0 |
| A-2 | 6 | 65 | 0 | 25 | 3 | 1 | 0 |
| A-3 | 3 | 0 | 0 | 0 | 95 | 2 | 0 |
| A-4 | 2 | 0 | 6 | 11 | 79 | 2 | 0 |
| A-5 | 5 | 18 | 0 | 0 | 65 | 4 | 8 |
| A-6 | 3 | 5 | 13 | 0 | 70 | 9 | 0 |
| A-7 | 2 | 4 | 4 | 5 | 83 | 2 | 0 |
| A-8 | 2 | 6 | 11 | 0 | 71 | 10 | 0 |
| A-9 | 0 | 20 | 4 | 3 | 65 | 3 | 5 |
| A-10 | 25 | 5 | 0 | 0 | 65 | 5 | 0 |
| A-11 | 3 | 67 | 5 | 19 | 0 | 6 | 0 |
| B-1 | 0 | 7 | 5 | 0 | 77 | 11 | 0 |
| C-1 | 0 | 4 | 1 | 0 | 85 | 10 | 0 |
| D-1 | 0 | 5 | 2 | 0 | 82 | 11 | 0 |
| E-1 | 0 | 4 | 3 | 0 | 81 | 12 | 0 |
| F-1 | 0 | 2 | 0 | 0 | 87 | 11 | 0 |
| G-1 | 5 | 6 | 5 | 0 | 75 | 9 | 0 |
| G-2 | 28 | 3 | 5 | 0 | 57 | 7 | 0 |
| G-3 | 3 | 3 | 15 | 5 | 65 | 9 | 0 |
| G-4 | 3 | 4 | 19 | 4 | 60 | 10 | 0 |
| G-5 | 0 | 0 | 6 | 7 | 82 | 5 | 0 |
| G-6 | 0 | 32 | 0 | 5 | 60 | 3 | 0 |
| G-7 | 0 | 3 | 0 | 0 | 84 | 13 | 0 |
| G-8 | 35 | 39 | 0 | 22 | 0 | 1 | 3 |
| G-9 | 0 | 0 | 0 | 0 | 99 | 1 | 0 |
| H-1 | 0 | 9 | 0 | 0 | 75 | 16 | 0 |
| I-1 | 0 | 7 | 3 | 0 | 75 | 15 | 0 |
| J-1 | 0 | 6 | 2 | 0 | 77 | 15 | 0 |
| K-1 | 0 | 0 | 0 | 0 | 83 | 17 | 0 |
| L-1 | 0 | 6 | 3 | 0 | 78 | 13 | 0 |
| M-1 | 2 | 4 | 8 | 3 | 71 | 12 | 0 |
| N-1 | 3 | 4 | 8 | 6 | 70 | 9 | 0 |
| O-1 | 2 | 2 | 9 | 2 | 73 | 12 | 0 |
| P-1 | 2 | 0 | 8 | 1 | 77 | 12 | 0 |
| Q-1 | 2 | 0 | 9 | 0 | 70 | 19 | 0 |
| R-1 | 5 | 1 | 9 | 0 | 70 | 15 | 0 |

TABLE 6-continued

| SAMPLE | STEEL STRUCTURE (%) TOTAL OF TEMPERED MARTENSITE AND BAINITE | EFFECTIVE CRYSTAL GRAIN DIAMETER (μm) | IRON-BASE CARBIDE NUMBER DENSITY ×10$^6$ (PIECES/mm$^2$) | IRON-BASE CARBIDE AVERAGE LENGTH (nm) | REMARK |
|---|---|---|---|---|---|
| A-1 | 81 | 2.5 | 2.83 | 42 | INVENTION EXAMPLE |
| A-2 | 68 | 4.5 | 0.08 | | COMPARATIVE EXAMPLE |
| A-3 | 95 | 2.6 | 8.31 | 39 | COMPARATIVE EXAMPLE |
| A-4 | 85 | 2.8 | 0.70 | 24 | COMPARATIVE EXAMPLE |
| A-5 | 83 | 6.5 | 2.92 | 430 | COMPARATIVE EXAMPLE |
| A-6 | 88 | 2.5 | 2.85 | 36 | INVENTION EXAMPLE |
| A-7 | 91 | 2.8 | 2.79 | 45 | COMPARATIVE EXAMPLE |
| A-8 | 88 | 2.8 | 2.93 | 42 | INVENTION EXAMPLE |
| A-9 | 89 | 4.5 | 3.06 | 43 | COMPARATIVE EXAMPLE |
| A-10 | 70 | 5.9 | 2.34 | 41 | COMPARATIVE EXAMPLE |
| A-11 | 72 | 4.1 | 0.06 | | COMPARATIVE EXAMPLE |
| B-1 | 89 | 2.8 | 2.75 | 39 | INVENTION EXAMPLE |
| C-1 | 90 | 3.5 | 2.89 | 36 | INVENTION EXAMPLE |
| D-1 | 89 | 3.4 | 2.05 | 38 | INVENTION EXAMPLE |
| E-1 | 88 | 3.8 | 2.24 | 42 | INVENTION EXAMPLE |
| F-1 | 89 | 2.9 | 2.86 | 43 | INVENTION EXAMPLE |
| G-1 | 86 | 2.8 | 2.45 | 39 | INVENTION EXAMPLE |
| G-2 | 65 | 5.9 | 2.53 | 40 | COMPARATIVE EXAMPLE |
| G-3 | 83 | 3.9 | 2.66 | 43 | INVENTION EXAMPLE |
| G-4 | 83 | 4.2 | 2.44 | 33 | INVENTION EXAMPLE |
| G-5 | 88 | 3.5 | 0.98 | | COMPARATIVE EXAMPLE |
| G-6 | 92 | 4.8 | 3.31 | 450 | COMPARATIVE EXAMPLE |
| G-7 | 87 | 3.5 | 3.33 | 42 | INVENTION EXAMPLE |
| G-8 | 74 | 7.1 | 0.05 | | COMPARATIVE EXAMPLE |
| G-9 | 99 | 2.8 | 10.74 | 27 | COMPARATIVE EXAMPLE |
| H-1 | 84 | 2.8 | 3.75 | 40 | INVENTION EXAMPLE |
| I-1 | 85 | 2.6 | 3.34 | 38 | INVENTION EXAMPLE |
| J-1 | 85 | 2.6 | 3.51 | 42 | INVENTION EXAMPLE |
| K-1 | 83 | 2.7 | 3.38 | 41 | INVENTION EXAMPLE |
| L-1 | 87 | 3.1 | 3.62 | 43 | INVENTION EXAMPLE |
| M-1 | 83 | 3.5 | 3.55 | 35 | INVENTION EXAMPLE |
| N-1 | 82 | 3.5 | 2.99 | 35 | INVENTION EXAMPLE |
| O-1 | 84 | 3.4 | 2.35 | 36 | INVENTION EXAMPLE |
| P-1 | 85 | 3.2 | 2.11 | 55 | INVENTION EXAMPLE |
| Q-1 | 79 | 3.5 | 2.55 | 45 | INVENTION EXAMPLE |
| R-1 | 80 | 3.6 | 2.26 | 45 | INVENTION EXAMPLE |

TABLE 7

| SAMPLE | STEEL STRUCTURE (%) FERRITE | UPPER BAINITE | LOWER BAINITE | FRESH MARTENSITE | TEMPERED MARTENSITE | RETAINED AUSTENITE | PEARLITE |
|---|---|---|---|---|---|---|---|
| S-1 | 0 | 11 | 5 | 0 | 75 | 9 | 0 |
| S-2 | 0 | 13 | 5 | 2 | 69 | 11 | 0 |
| S-3 | 0 | 12 | 4 | 5 | 70 | 9 | 0 |
| S-4 | 0 | 11 | 4 | 4 | 70 | 11 | 0 |
| S-5 | 0 | 30 | 4 | 62 | 2 | 2 | 0 |
| S-6 | 0 | 10 | 3 | 0 | 77 | 10 | 0 |
| S-7 | 0 | 2 | 2 | 3 | 81 | 12 | 0 |
| S-8 | 0 | 4 | 5 | 0 | 78 | 13 | 0 |
| S-9 | 0 | 4 | 4 | 0 | 78 | 14 | 0 |
| S-10 | 30 | 3 | 5 | 0 | 59 | 3 | 0 |
| S-11 | 0 | 30 | 0 | 11 | 55 | 4 | 0 |
| S-12 | 0 | 7 | 12 | 0 | 68 | 2 | 11 |
| S-13 | 0 | 38 | 13 | 44 | 2 | 3 | 0 |
| S-14 | 0 | 5 | 2 | 3 | 82 | 3 | 5 |
| T-1 | 0 | 3 | 3 | 0 | 77 | 17 | 0 |
| U-1 | 0 | 4 | 3 | 2 | 75 | 16 | 0 |
| V-1 | 0 | 3 | 4 | 0 | 75 | 18 | 0 |
| W-1 | 0 | 9 | 4 | 2 | 70 | 15 | 0 |
| W-2 | 0 | 7 | 3 | 11 | 75 | 2 | 2 |
| W-3 | 0 | 6 | 2 | 0 | 77 | 15 | 0 |
| X-1 | 0 | 3 | 2 | 2 | 70 | 23 | 0 |
| Y-1 | 0 | 6 | 3 | 4 | 65 | 22 | 0 |
| a-1 | 32 | 4 | 12 | 40 | 11 | 1 | 0 |
| b-1 | 0 | 4 | 15 | 6 | 68 | 7 | 0 |
| c-1 | 13 | 15 | 14 | 35 | 21 | 2 | 0 |
| d-1 | 35 | 12 | 16 | 2 | 32 | 3 | 0 |
| e-1 | 3 | 5 | 8 | 4 | 67 | 13 | 0 |
| f-1 | 4 | 6 | 8 | 3 | 66 | 13 | 0 |
| g-1 | 30 | 21 | 11 | 21 | 15 | 2 | 0 |
| h-1 | 0 | 3 | 4 | 9 | 65 | 12 | 0 |
| i-1 | 0 | 6 | 10 | 3 | 68 | 13 | 0 |
| j-1 | 0 | 7 | 5 | 3 | 74 | 11 | 0 |
| k-1 | 0 | 2 | 2 | 4 | 73 | 11 | 0 |

| SAMPLE | STEEL STRUCTURE (%) TOTAL OF TEMPERED MARTENSITE AND BAINITE | EFFECTIVE CRYSTAL GRAIN DIAMETER (μm) | IRON-BASE CARBIDE NUMBER DENSITY $\times 10^6$ (PIECES/mm$^2$) | IRON-BASE CARBIDE AVERAGE LENGTH (nm) | REMARK |
|---|---|---|---|---|---|
| S-1 | 91 | 2.8 | 2.83 | 42 | INVENTION EXAMPLE |
| S-2 | 87 | 6.4 | 2.44 | 48 | COMPARATIVE EXAMPLE |
| S-3 | 86 | 8.5 | 2 55 | 39 | COMPARATIVE EXAMPLE |
| S-4 | 85 | 6.3 | 2.11 | 44 | COMPARATIVE EXAMPLE |
| S-5 | 36 | 5.8 | 0.08 | | COMPARATIVE EXAMPLE |
| S-6 | 90 | 7.5 | 2.85 | 36 | COMPARATIVE EXAMPLE |
| S-7 | 85 | 2.8 | 2.79 | 45 | INVENTION EXAMPLE |
| S-8 | 87 | 6.5 | 2.93 | 42 | COMPARATIVE EXAMPLE |
| S-9 | 86 | 3.5 | 0.84 | | COMPARATIVE EXAMPLE |
| S-10 | 67 | 6.5 | 2.34 | 41 | COMPARATIVE EXAMPLE |
| S-11 | 85 | 4.5 | 2.22 | 42 | COMPARATIVE EXAMPLE |
| S-12 | 87 | 5.5 | 2.75 | 39 | COMPARATIVE EXAMPLE |
| S-13 | 53 | 3.5 | 2.89 | 36 | COMPARATIVE EXAMPLE |
| S-14 | 89 | 3.2 | 2.05 | 38 | COMPARATIVE EXAMPLE |
| T-1 | 83 | 2.8 | 3.33 | 42 | INVENTION EXAMPLE |
| U-1 | 82 | 3.5 | 3.54 | 46 | INVENTION EXAMPLE |
| V-1 | 82 | 4.1 | 2.11 | 27 | INVENTION EXAMPLE |

TABLE 7-continued

| | | | | | |
|---|---|---|---|---|---|
| W-1 | 83 | 3.5 | 3.75 | 40 | INVENTION EXAMPLE |
| W-2 | 85 | 2.5 | 3.34 | 38 | COMPARATIVE EXAMPLE |
| W-3 | 85 | 2.1 | 3.51 | 42 | INVENTION EXAMPLE |
| X-1 | 75 | 3.4 | 3.38 | 41 | INVENTION EXAMPLE |
| Y-1 | 74 | 3.5 | 3.62 | 43 | INVENTION EXAMPLE |
| a-1 | 27 | 3.5 | 2.55 | 44 | COMPARATIVE EXAMPLE |
| b-1 | 87 | 3.2 | 2.35 | 45 | COMPARATIVE EXAMPLE |
| c-1 | 50 | 3.5 | 2.22 | 41 | COMPARATIVE EXAMPLE |
| d-1 | 60 | 2.8 | 2.44 | 43 | COMPARATIVE EXAMPLE |
| e-1 | 80 | 3.5 | 3.88 | 46 | COMPARATIVE EXAMPLE |
| f-1 | 80 | 2.8 | 3.55 | 62 | COMPARATIVE EXAMPLE |
| g-1 | 47 | 2.5 | 2.88 | 34 | COMPARATIVE EXAMPLE |
| h-1 | 72 | 5.3 | 1.15 | 35 | COMPARATIVE EXAMPLE |
| i-1 | 84 | 5.1 | 1.32 | 35 | COMPARATIVE EXAMPLE |
| j-1 | 86 | 5.4 | 1.22 | 41 | COMPARATIVE EXAMPLE |
| k-1 | 77 | 5.6 | 1.25 | 42 | COMPARATIVE EXAMPLE |

Furthermore, evaluation of strength, ductility, hole expandability, hydrogen embrittlement resistance and toughness of each of the steel sheets after the skin pass rolling was performed.

In the evaluation of strength and ductility, a JIS No. 5 test piece in which a direction perpendicular to a rolling direction was set as a longitudinal direction was picked from each of the steel sheets, and a tensile test was performed in conformity to JISZ2242, to measure a tensile strength TS and a total elongation El. In the evaluation of hole expandability, a hole expansion test was performed in conformity to the Japan Iron and Steel Federation Standard JFST1001, to measure a hole expansion ratio λ. Table 8 and Table 9 present these results. Underlines in Table 8 and Table 9 indicate that numerical values thereon deviate from desirable ranges. The desirable ranges mentioned here mean that a tensile strength TS is 980 MPa or more, an index of ductility (TS×El) is 15000 MPa % or more, an index of hole expandability ($TS^{1.7}\times\lambda$) is 5000000 $MPa^{1.7}$% or more.

In the evaluation of hydrogen embrittlement resistance, a strip-shaped test piece with 100 mm×30 mm in which a direction perpendicular to a rolling direction was set as a longitudinal direction was picked from each of the steel sheets, and holes for stress application were formed at both ends thereof. Next, the test piece was bent at a radius of 10 mm, a surface of a bend apex of the test piece was equipped with a strain gauge, bolts were passed through the holes at both the ends, and nuts were fixed to the tips of the bolts. Then, stress was applied to the test piece by tightening the bolts and the nuts. The stress to be applied was set to 60% and 90% of a maximum tensile strength TS measured by an additional tensile test, and in applying the stress, a strain read from the strain gauge was converted into the stress by Young's modulus. Thereafter, the test piece was immersed in an aqueous ammonium thiocyanate solution and subjected to electrolytic hydrogen charging at a current density of 0.1 $mA/cm^2$, to observe occurrence of a crack after two hours. Then, the one which was not fractured by a load stress of 60% of the maximum tensile strength TS and was fractured by a load stress of 90% of the maximum tensile strength TS was judged "passing", the one which was fractured by both of the conditions was judged "poor", and the one which was not fractured by either of the conditions was judged "good". Table 8 and Table 9 present this result. In Table 8 and Table 9, "good" is represented by "○", "passing" is represented by "Δ", and "poor" is represented by "X". Underlines in Table 8 and Table 9 indicate that numerical values thereon deviate from a desirable range.

In the evaluation of toughness, a Charpy impact test was performed. A test level fixed a sheet thickness at 1.2 mm, and the test was performed at a test temperature of −40° C. three times, to measure an absorbed energy at −40° C. Table 8 and Table 9 present this result. Underlines in Table 8 and Table 9 indicate that numerical values thereon deviate from a desirable range. The desirable range mentioned here means that the absorbed energy is 40 $J/cm^2$ or more.

TABLE 8

| | STRENGTH, DUCTILITY, HOLE EXPANDABILITY | | | | | HYDROGEN EMBRITTLEMENT | TOUGHNESS ABSORBED | |
|---|---|---|---|---|---|---|---|---|
| SAMPLE | TS (MPa) | EI (%) | λ (%) | TS & EI (MPa × %) | $TS^{1.7}\times\lambda$ ($MPa^{1.7}$ × %) | RESISTANCE EVALUATION | ENERGY ($J/cm^2$) | REMARK |
| A-1 | 1023 | 21 | 50 | 21483 | 6542724 | ○ | 55 | INVENTION EXAMPLE |

TABLE 8-continued

| SAMPLE | STRENGTH, DUCTILITY, HOLE EXPANDABILITY TS (MPa) | EI (%) | λ (%) | TS & EI (MPa × %) | $TS^{1.7} \times \lambda$ ($MPa^{1.7} \times$ %) | HYDROGEN EMBRITTLEMENT RESISTANCE EVALUATION | TOUGHNESS ABSORBED ENERGY ($J/cm^2$) | REMARK |
|---|---|---|---|---|---|---|---|---|
| A-2 | 1060 | 14 | 15 | 14840 | 2085025 | X | 35 | COMPARATIVE EXAMPLE |
| A-3 | 1353 | 8 | 30 | 10824 | 6314333 | ○ | 45 | COMPARATIVE EXAMPLE |
| A-4 | 1070 | 11 | 18 | 11770 | 2542289 | Δ | 33 | COMPARATIVE EXAMPLE |
| A-5 | 968 | 14 | 22 | 13552 | 2620661 | ○ | 30 | COMPARATIVE EXAMPLE |
| A-6 | 1037 | 18 | 55 | 18666 | 7365234 | ○ | 60 | INVENTION EXAMPLE |
| A-7 | 1052 | 12 | 40 | 12624 | 5488918 | ○ | 38 | COMPARATIVE EXAMPLE |
| A-8 | 1029 | 18 | 52 | 18522 | 6872417 | ○ | 50 | INVENTION EXAMPLE |
| A-9 | 936 | 14 | 25 | 13104 | 2812606 | ○ | 30 | COMPARATIVE EXAMPLE |
| A-10 | 946 | 18 | 20 | 17028 | 2291105 | Δ | 25 | COMPARATIVE EXAMPLE |
| A-11 | 1062 | 15 | 18 | 15930 | 2510060 | X | 20 | COMPARATIVE EXAMPLE |
| B-1 | 1009 | 22 | 55 | 22198 | 7030362 | ○ | 45 | INVENTION EXAMPLE |
| C-1 | 1039 | 21 | 56 | 21819 | 7523752 | ○ | 55 | INVENTION EXAMPLE |
| D-1 | 1028 | 20 | 45 | 20560 | 5937462 | ○ | 50 | INVENTION EXAMPLE |
| E-1 | 1030 | 21 | 43 | 21630 | 5692352 | ○ | 58 | INVENTION EXAMPLE |
| F-1 | 1042 | 21 | 43 | 21882 | 5805553 | ○ | 59 | INVENTION EXAMPLE |
| G-1 | 1212 | 16 | 40 | 19392 | 6982556 | ○ | 57 | INVENTION EXAMPLE |
| G-2 | 1168 | 17 | 20 | 19856 | 3278558 | Δ | 25 | COMPARATIVE EXAMPLE |
| G-3 | 1193 | 14 | 42 | 16702 | 7137367 | ○ | 45 | INVENTION EXAMPLE |
| G-4 | 1195 | 13 | 45 | 15535 | 7668986 | ○ | 43 | INVENTION EXAMPLE |
| G-5 | 1124 | 9 | 25 | 10116 | 3839218 | Δ | 30 | COMPARATIVE EXAMPLE |
| G-6 | 1121 | 9 | 40 | 10089 | 6114902 | ○ | 40 | COMPARATIVE EXAMPLE |
| G-7 | 1187 | 15 | 50 | 17805 | 8424347 | ○ | 55 | INVENTION EXAMPLE |
| G-8 | 1199 | 8 | 25 | 9592 | 4284820 | X | 29 | COMPARATIVE EXAMPLE |
| G-9 | 1277 | 9 | 40 | 11493 | 7631054 | ○ | 46 | COMPARATIVE EXAMPLE |
| H-1 | 1232 | 17 | 40 | 20944 | 7179566 | ○ | 48 | INVENTION EXAMPLE |
| I-1 | 1243 | 16 | 45 | 19888 | 8199992 | ○ | 50 | INVENTION EXAMPLE |
| J-1 | 1257 | 15 | 55 | 18855 | 10214866 | ○ | 55 | INVENTION EXAMPLE |
| K-1 | 1252 | 14 | 50 | 17528 | 9223534 | ○ | 54 | INVENTION EXAMPLE |
| L-1 | 1241 | 15 | 52 | 18615 | 9449642 | ○ | 52 | INVENTION EXAMPLE |
| M-1 | 1241 | 16 | 56 | 19856 | 10176538 | ○ | 53 | INVENTION EXAMPLE |
| N-1 | 1211 | 14 | 40 | 16954 | 6972765 | ○ | 53 | INVENTION EXAMPLE |
| O-1 | 1189 | 15 | 45 | 17835 | 7603642 | ○ | 55 | INVENTION EXAMPLE |
| P-1 | 1344 | 13 | 30 | 17472 | 6243096 | ○ | 55 | INVENTION EXAMPLE |
| Q-1 | 1355 | 15 | 30 | 20325 | 6330209 | ○ | 45 | INVENTION EXAMPLE |
| R-1 | 1421 | 15 | 30 | 21315 | 6863272 | ○ | 50 | INVENTION EXAMPLE |

TABLE 9

| SAMPLE | STRENGTH DUCTILITY, HOLE EXPANDABILITY | | | | | HYDROGEN EMBRITTLEMENT | TOUGHNESS ABSORBED | REMARK |
|---|---|---|---|---|---|---|---|---|
| | TS (MPa) | EI (%) | λ (%) | TS × EI (MPa × %) | $TS^{1.7} \times \lambda$ ($MPa^{1.7} \times \%$) | RESISTANCE EVALUATION | ENERGY ($J/cm^2$) | |
| S-1 | 1521 | 20 | 30 | 30420 | 7704437 | ○ | 45 | INVENTION EXAMPLE |
| S-2 | 1544 | 19 | 18 | 29336 | 4742124 | X | 30 | COMPARATIVE EXAMPLE |
| S-3 | 1524 | 18 | 19 | 27432 | 4895849 | Δ | 28 | COMPARATIVE EXAMPLE |
| S-4 | 1480 | 16 | 25 | 23680 | 6128934 | Δ | 29 | COMPARATIVE EXAMPLE |
| S-5 | 1755 | 8 | 10 | 14040 | 3275451 | X | 25 | COMPARATIVE EXAMPLE |
| S-6 | 1499 | 19 | 18 | 28481 | 4509572 | ○ | 21 | COMPARATIVE EXAMPLE |
| S-7 | 1485 | 18 | 26 | 26730 | 6410742 | ○ | 45 | INVENTION EXAMPLE |
| S-8 | 1511 | 18 | 20 | 27198 | 5079016 | ○ | 25 | COMPARATIVE EXAMPLE |
| S-9 | 1355 | 12 | 15 | 16260 | 3165105 | X | 35 | COMPARATIVE EXAMPLE |
| S-10 | 1255 | 15 | 15 | 18825 | 2778341 | X | 30 | COMPARATIVE EXAMPLE |
| S-11 | 1344 | 17 | 12 | 22848 | 2497238 | X | 25 | COMPARATIVE EXAMPLE |
| S-12 | 1355 | 21 | 15 | 28455 | 3165105 | X | 34 | COMPARATIVE EXAMPLE |
| S-13 | 1499 | 9 | 35 | 13491 | 8768611 | X | 45 | COMPARATIVE EXAMPLE |
| S-14 | 1422 | 11 | 20 | 15642 | 4580990 | X | 25 | COMPARATIVE EXAMPLE |
| T-1 | 1422 | 15 | 35 | 21330 | 8016732 | ○ | 44 | INVENTION EXAMPLE |
| U-1 | 1466 | 16 | 30 | 23456 | 7236841 | ○ | 45 | INVENTION EXAMPLE |
| V-1 | 1455 | 18 | 25 | 26190 | 5953976 | ○ | 43 | INVENTION EXAMPLE |
| W-1 | 1550 | 13 | 20 | 20150 | 5303882 | ○ | 41 | INVENTION EXAMPLE |
| W-2 | 1219 | 12 | 44 | 14628 | 7756378 | ○ | 40 | COMPARATIVE EXAMPLE |
| W-3 | 1571 | 11 | 20 | 17281 | 5426621 | ○ | 40 | INVENTION EXAMPLE |
| X-1 | 1550 | 10 | 21 | 15500 | 5569076 | ○ | 41 | INVENTION EXAMPLE |
| Y-1 | 1560 | 14 | 20 | 21840 | 5362185 | ○ | 40 | INVENTION EXAMPLE |
| a-1 | 1011 | 13 | 20 | 13143 | 2565116 | ○ | 30 | COMPARATIVE EXAMPLE |
| b-1 | 1611 | 9 | 15 | 14499 | 4247698 | X | 35 | COMPARATIVE EXAMPLE |
| c-1 | 1422 | 8 | 30 | 11376 | 6871484 | ○ | 44 | COMPARATIVE EXAMPLE |
| d-1 | 1433 | 7 | 20 | 10031 | 4641395 | X | 32 | COMPARATIVE EXAMPLE |
| e-1 | 1195 | 13 | 25 | 15535 | 4260548 | X | 25 | COMPARATIVE EXAMPLE |
| f-1 | 1442 | 12 | 20 | 17304 | 4691059 | X | 32 | COMPARATIVE EXAMPLE |
| g-1 | 1099 | 15 | 21 | 16485 | 3103955 | X | 31 | COMPARATIVE EXAMPLE |
| h-1 | 1540 | 13 | 18 | 20020 | 4721258 | ○ | 34 | COMPARATIVE EXAMPLE |
| i-1 | 1365 | 16 | 43 | 21840 | 9187428 | ○ | 33 | COMPARATIVE EXAMPLE |
| j-1 | 1035 | 23 | 42 | 24012 | 5605933 | ○ | 38 | COMPARATIVE EXAMPLE |
| k-1 | 1026 | 20 | 48 | 20828 | 6312360 | ○ | 36 | COMPARATIVE EXAMPLE |

As illustrated in Table 8 and Table 9, samples in the present invention range, A-1, A-6, A-8, B-1, C-1, D-1, E-1, F-1, G-1, G-3, G-4, G-7, H-1, I-1, J-1, K-1, L-1, M-1, N-1, O-1, P-1, Q-1, R-1, S-1, S-7, T-1, U-1, V-1, W-1, W-3, X-1 and Y-1 were able to obtain excellent tensile strength, ductility, hole expandability, hydrogen embrittlement resistance and toughness.

On the other hand, in a sample A-2, a volume fraction of retained austenite was too low, a volume fraction of fresh martensite was too high, a total volume fraction of tempered martensite and bainite was too low, and a number density of iron-base carbides was too low, so that ductility, hole expandability, a hydrogen embrittlement characteristic and toughness were low.

In a sample A-3, a volume fraction of retained austenite was too low and a total volume fraction of tempered martensite and bainite was too high, so that ductility was low.

In a sample A-4, a volume fraction of retained austenite was too low, a volume fraction of fresh martensite was too high, and a number density of iron-base carbides was too low, so that ductility, hole expandability and toughness were low.

In a sample A-5, a volume fraction of retained austenite was too low and an effective crystal grain diameter of tempered martensite and bainite was too large, so that ductility, hole expandability, and toughness were low.

In a sample A-7, a volume fraction of retained austenite was too low, so that ductility and toughness were low.

In a sample A-9, a volume fraction of retained austenite was too low, so that ductility, hole expandability and toughness were low.

In a sample A-10, a volume fraction of ferrite was too high, a volume fraction of retained austenite was too low, and an effective crystal grain diameter of tempered martensite and bainite was too large, so that hole expandability and toughness were low.

In a sample A-11, a volume fraction of retained austenite was too low, a volume fraction of fresh martensite was too high, and a number density of iron-base carbides was too low, so that hole expandability, a hydrogen embrittlement characteristic and toughness were low.

In a sample G-2, a volume fraction of ferrite was too high, a volume fraction of retained austenite was too low, a total volume fraction of tempered martensite and bainite was too low, and an effective crystal grain diameter of tempered martensite and bainite was too large, so that hole expandability and toughness were low.

In a sample G-5, a volume fraction of retained austenite was too low and a number density of iron-base carbides was too low, so that ductility, hole expandability and toughness were low.

In a sample G-6, a volume fraction of retained austenite was too low, so that ductility was low.

In a sample G-8, a volume fraction of ferrite was too high, a volume fraction of retained austenite was too low, a volume fraction of fresh martensite was too high, an effective crystal grain diameter of tempered martensite and bainite was too large, and a number density of iron-base carbides was too low, so that ductility, hole expandability, a hydrogen embrittlement characteristic and toughness were low.

In a sample G-9, a volume fraction of retained austenite was too low and a total volume fraction of tempered martensite and bainite was too high, so that ductility was low.

In a sample S-2, an effective crystal grain diameter of tempered martensite and bainite was too large, so that hole expandability, hydrogen embrittlement resistance and toughness were low.

In a sample S-3, an effective crystal grain diameter of tempered martensite and bainite was too large, so that hole expandability and toughness were low.

In a sample S-4, an effective crystal grain diameter of tempered martensite and bainite was too large, so that toughness was low.

In a sample S-5, a volume fraction of retained austenite was too low, a volume fraction of fresh martensite was too high, a total volume fraction of tempered martensite and bainite was too low, an effective crystal grain diameter of tempered martensite and bainite was too large, and a number density of iron-base carbides was too low, so that ductility, hole expandability, a hydrogen embrittlement characteristic and toughness were low.

In a sample S-6, an effective crystal grain diameter of tempered martensite and bainite was too large, so that hole expandability and toughness were low.

In a sample S-8, an effective crystal grain diameter of tempered martensite and bainite was too large, so that toughness was low.

In a sample S-9, a number density of iron-base carbides was too low, so that hole expandability, hydrogen embrittlement resistance and toughness were low.

In a sample S-10, a volume fraction of ferrite was too high, a volume fraction of retained austenite was too low, a total volume fraction of tempered martensite and bainite was too low, and an effective crystal grain diameter of tempered martensite and bainite was too large, so that hole expandability, hydrogen embrittlement resistance and toughness were low.

In a sample S-11, a volume fraction of retained austenite was too low and a volume fraction of fresh martensite was too high, so that hole expandability, hydrogen embrittlement resistance and toughness were low.

In a sample S-12, a volume fraction of retained austenite was too low, a volume fraction of pearlite was too high, and an effective crystal grain diameter of tempered martensite and bainite was too large, so that hole expandability, a hydrogen embrittlement characteristic and toughness were low.

In a sample S-13, a volume fraction of retained austenite was too low and a volume fraction of fresh martensite was too high, so that ductility and hydrogen embrittlement resistance were low.

In a sample S-14, a volume fraction of retained austenite was too low, so that hole expandability, a hydrogen embrittlement characteristic and toughness were low.

In a sample W-2, a volume fraction of fresh martensite was too high and a volume fraction of retained austenite was too low, so that ductility was low.

In a sample a-1, the C content was too low, a volume fraction of ferrite was too high, a volume fraction of retained austenite was too low, a volume fraction of fresh martensite was too high, and a total volume fraction of tempered martensite and bainite was too low, so that ductility, hole expandability and toughness were low.

In a sample b-1, the C content was too high and a volume fraction of retained austenite was too low, so that ductility, hole expandability, hydrogen embrittlement resistance and toughness were low.

In a sample c-1, the Si content was too low, a volume fraction of ferrite was too high, a volume fraction of retained austenite was too low, a volume fraction of fresh martensite was too high, and a total volume fraction of tempered martensite and bainite was too low, so that ductility was low.

In a sample d-1, the Mn content was too low, a volume fraction of ferrite was too high, a volume fraction of retained austenite was too low, and a total volume fraction of tempered martensite and bainite was too low, so that ductility, hole expandability, hydrogen embrittlement resistance and toughness were low.

In a sample e-1, the P content was too high, so that hole expandability, hydrogen embrittlement resistance and toughness were low.

In a sample f-1, the S content was too high, so that hole expandability, hydrogen embrittlement resistance and toughness were low.

In a sample g-1, the Al content was too low, a volume fraction of ferrite was too high, a volume fraction of retained austenite was too low, a volume fraction of fresh martensite was too high, and a total volume fraction of tempered martensite and bainite was too low, so that hole expandability, hydrogen embrittlement resistance and toughness were low.

In a sample h-1, an effective crystal grain diameter of tempered martensite and bainite was too large. Therefore, hole expandability and toughness were low.

In a sample i-1, an effective crystal grain diameter of tempered martensite and bainite was too large. Therefore, toughness was low.

In a sample j-1, an effective crystal grain diameter of tempered martensite and bainite was too large. Therefore, toughness was low.

In a sample k-1, an effective crystal grain diameter of tempered martensite and bainite was too large. Therefore, toughness was low.

When attention was focused on the manufacturing method, in the sample A-2, a cooling stop temperature in the continuous annealing was too high. Therefore, the volume fraction of fresh martensite became too high, the volume fraction of retained austenite became too low, the total volume fraction of tempered martensite and bainite became too low, and the number density of iron-base carbides became too low.

In the sample A-3, a cooling stop temperature in the continuous annealing was too low. Therefore, the volume fraction of retained austenite became too low and the total volume fraction of tempered martensite and bainite became too high.

In the sample A-4, a holding temperature in the tempering treatment was too low. Therefore, the volume fraction of fresh martensite became too high, the volume fraction of retained austenite became too low, and the number density of iron-base carbides became too low.

In the sample A-5, a holding temperature in the tempering treatment was too high. Therefore, the volume fraction of retained austenite became too low, and the effective crystal grain diameter of tempered martensite and bainite became too large.

In the sample A-7, a holding time in the tempering treatment was too short. Therefore, the volume fraction of retained austenite became too low.

In the sample A-9, a temperature for the alloying treatment was too high. The volume fraction of retained austenite became too low.

In the sample A-10, a holding temperature in the continuous annealing was too low. Therefore, the volume fraction of ferrite became too high, the volume fraction of retained austenite became too low, and the effective crystal grain diameter of tempered martensite and bainite became too large.

In the sample A-11, a cooling stop temperature in the continuous annealing was too high. Therefore, the volume fraction of fresh martensite became too high, the volume fraction of retained austenite became too low, and the number density of iron-base carbides became too low.

In the sample G-2, a heating rate in the continuous annealing was too low. Therefore, the volume fraction of ferrite became too high, the volume fraction of retained austenite became too low, the total volume fraction of tempered martensite and bainite became too low, and the effective crystal grain diameter of tempered martensite and bainite became too large.

In the sample G-5, a holding temperature in the tempering treatment was too low. Therefore, the volume fraction of retained austenite became too low, and the number density of iron-base carbides became too low.

In the sample G-6, a cooling stop temperature in the continuous annealing was too low, and a holding temperature in the tempering treatment was too high. Therefore, the volume fraction of retained austenite became too low.

In the sample G-8, an average cooling rate was too low and a cooling stop temperature was too high in the continuous annealing. Therefore, the volume fraction of ferrite became too high, the volume fraction of fresh martensite became too high, the volume fraction of retained austenite became too low, the effective crystal grain diameter of tempered martensite and bainite became too large, and the number density of iron-base carbides became too low.

In the sample G-9, a cooling stop temperature was too low in the continuous annealing, and a holding time in the tempering treatment was too short. Therefore, the volume fraction of retained austenite became too low, and the total volume fraction of tempered martensite and bainite became too high.

In the sample S-2, the number of passes under a predetermined condition in the rough rolling was "0" (zero), and an entry-side temperature in the fourth rolling mill in the finish rolling was too high, and a finishing temperature was too high. Therefore, the effective crystal grain diameter of tempered martensite and bainite became too large.

In the sample S-3, a pass-through time during the rolling in the final three stages in the finish rolling was too long, and an elapsed time from the rolling in the final stage to a water-cooling start was too long. Therefore, the effective crystal grain diameter of tempered martensite and bainite became too large.

In the sample S-4, a total reduction ratio in the final three stages in the finish rolling was too low. Therefore, the effective crystal grain diameter of tempered martensite and bainite became too large.

In the sample S-5, a cooling stop temperature in the continuous annealing was too low. Therefore, the volume fraction of fresh martensite became too high, the volume fraction of retained austenite became too low, the total volume fraction of tempered martensite and bainite became too low, the effective crystal grain diameter of tempered martensite and bainite became too large, and the number density of iron-base carbides became too low.

In the sample S-6, a heating rate in the continuous annealing was too low. Therefore, the effective crystal grain diameter of tempered martensite and bainite became too large.

In the sample S-8, a holding temperature in the continuous annealing was too high. Therefore, the effective crystal grain diameter of tempered martensite and bainite became too large.

In the sample S-9, a holding time in the continuous annealing was too short. Therefore, the number density of iron-base carbides became too low.

In the sample S-10, a cooling stop temperature in the continuous annealing was too low. Therefore, the volume fraction of ferrite became too high, the volume fraction of retained austenite became too low, the total volume fraction of tempered martensite and bainite became too low, and the effective crystal grain diameter of tempered martensite and bainite became too large.

In the sample S-11, a holding temperature in the tempering treatment was too high. Therefore, the volume fraction of fresh martensite became too high and the volume fraction of retained austenite became too low.

In the sample S-12, a holding time in the tempering treatment was too long. Therefore, the volume fraction of retained austenite became too low, the volume fraction of pearlite became too high, and the effective crystal grain diameter of tempered martensite and bainite became too large.

In the sample S-13, a cooling stop temperature in the continuous annealing was too high. Therefore, the volume fraction of retained austenite became too low and the volume fraction of fresh martensite became too high.

In the sample S-14, a cooling stop temperature in the continuous annealing was too low, and a temperature for the alloying treatment was too high. The volume fraction of retained austenite became too low.

In the sample W-2, a holding temperature in the tempering treatment was too high. Therefore, the volume fraction of fresh martensite became too high, and the volume fraction of retained austenite became too low.

In the sample i-1 and the sample j-1, an entry-side temperature in the fourth rolling mill in the finish rolling was too high. Therefore, the effective crystal grain diameter of tempered martensite and bainite became too large.

In the sample k-1, a pass-through time during the rolling in the final three stages in the finish rolling was too long, and an elapsed time from the rolling in the final stage to a water-cooling start was too long. Therefore, the effective crystal grain diameter of tempered martensite and bainite became too large.

In the sample 1-1, an extraction temperature from a heating furnace was too low. Therefore, a temperature before the finish rolling became too low, and the finish annealing was not performed.

INDUSTRIAL APPLICABILITY

The present invention can be utilized in, for example, an industry related to a steel sheet suitable for automotive parts.

The invention claimed is:

1. A steel sheet comprising:

a chemical composition represented by, in mass %,

C: 0.15% to 0.45%,

Si: 1.0% to 2.5%,

Mn: 1.2% to 3.5%,

Al: 0.001% to 2.0%,

P: 0.02% or less,

S: 0.02% or less,

N: 0.007% or less,

O: 0.01% or less,

Mo: 0.0% to 1.0%,

Cr: 0.0% to 2.0%,

Ni: 0.0% to 2.0%,

Cu: 0.0% to 2.0%,

Nb: 0.0% to 0.3%,

Ti: 0.0% to 0.3%,

V: 0.0% to 0.3%,

B: 0.00% to 0.01%,

Ca: 0.00% to 0.01%,

Mg: 0.00% to 0.01%,

REM: 0.00% to 0.01%, and the balance: Fe and impurities, and comprising a steel structure represented by, in a volume fraction, tempered martensite and bainite including lower bainite: 70% or more and less than 92% in total, retained austenite: 8% or more and less than 30%, ferrite: less than 10%, fresh martensite: less than 10%, and pearlite: less than 10%, in which a number density of iron-base carbides in the tempered martensite and lower bainite is, in term of pieces/$mm^2$, $1.0\times10^6$ or more, and an effective crystal grain diameter of the tempered martensite and the bainite is 5 μm or less.

2. The steel sheet according to claim 1, wherein the chemical composition further comprises, in mass %, one type or more selected from the group consisting of Mo: 0.01% to 1.0%, Cr: 0.05% to 2.0%, Ni: 0.05% to 2.0%, and Cu: 0.05% to 2.0%.

3. The steel sheet according to claim 1, wherein the chemical composition further comprises, in mass %, one type or more selected from the group consisting of:

Nb: 0.005% to 0.3%,

Ti: 0.005% to 0.3%, and

V: 0.005% to 0.3%.

4. The steel sheet according to claim 1, wherein the chemical composition further comprises, in mass %, B: 0.0001% to 0.01%.

5. The steel sheet according to claim 1, wherein the chemical composition further comprises, in mass %, one type or more selected from the group consisting of Ca: 0.0005% to 0.01%, Mg: 0.0005% to 0.01%, and REM: 0.0005% to 0.01%.

* * * * *